US008849169B2

(12) United States Patent
Hashiyada et al.

(10) Patent No.: US 8,849,169 B2
(45) Date of Patent: Sep. 30, 2014

(54) FIXING DEVICE AND IMAGE FORMING APPARATUS INCLUDING SAME

(75) Inventors: Tsuyoshi Hashiyada, Kanagawa (JP); Motokazu Hasegawa, Kanagawa (JP); Susumu Matsusaka, Kanagawa (JP); Yukari Isoe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 265 days.

(21) Appl. No.: 13/339,835

(22) Filed: Dec. 29, 2011

(65) Prior Publication Data

US 2012/0177418 A1 Jul. 12, 2012

(30) Foreign Application Priority Data

Jan. 11, 2011 (JP) ..... 2011-002890
Dec. 5, 2011 (JP) ..... 2011-266049

(51) Int. Cl.
*G03G 15/20* (2006.01)

(52) U.S. Cl.
CPC ..... *G03G 15/2053* (2013.01)
USPC ..... 399/328; 399/329

(58) Field of Classification Search
USPC ..... 399/328, 329
See application file for complete search history.

(56) References Cited

U.S. PATENT DOCUMENTS 6,037,576 A * 3/2000 Okabayashi et al. ..... 219/619
7,196,286 B2 3/2007 Kishi et al.
7,209,675 B2 4/2007 Matsusaka et al.
7,239,821 B2 7/2007 Matsusaka et al.
7,308,216 B2 12/2007 Kishi et al.
7,313,341 B2 12/2007 Matsusaka
7,333,743 B2 2/2008 Kishi et al.
7,343,113 B2 3/2008 Matsusaka et al.
7,356,270 B2 4/2008 Matsusaka et al.
7,366,432 B2 4/2008 Kishi et al.
7,379,287 B2 * 5/2008 Fujimoto ..... 361/267
7,390,995 B2 6/2008 Hasegawa et al.
7,415,235 B2 8/2008 Aze et al.
7,421,224 B2 9/2008 Kishi et al.
7,424,259 B2 * 9/2008 Samei et al. ..... 399/329
7,447,475 B2 11/2008 Ishibe et al.
7,480,478 B2 1/2009 Aze et al.
7,515,845 B2 4/2009 Kishi et al.

(Continued)

FOREIGN PATENT DOCUMENTS

JP 2004-86205 3/2004
JP 2004-94266 3/2004

(Continued)

*Primary Examiner* — David Bolduc
(74) *Attorney, Agent, or Firm* — Oblon, Spivak, McClelland, Maier & Neustadt, L.L.P.

(57) ABSTRACT

An induction heating-type fixing device includes a fixing member, an excitation coil, a magnetic core, a holder, and a pressing member. The fixing member includes a heat generating layer to heat and fuse a toner image on a recording medium. The excitation coil wound a predetermined number of times is disposed facing an outer surface of the fixing member, to generate a magnetic flux relative to the fixing member. The magnetic core forms a continuous magnetic path to direct the magnetic flux generated by the excitation coil to the fixing member. The holder holds the excitation coil and the magnetic core. The pressing member is disposed opposite the fixing member to press against the fixing member and form a fixing nip between the fixing member and the pressing member through which the recording medium is conveyed. The magnetic core is exposed from the holder at the fixing member side.

14 Claims, 15 Drawing Sheets

(56) References Cited

U.S. PATENT DOCUMENTS

| | | | | |
|---|---|---|---|---|
| 7,551,869 | B2 | 6/2009 | Kishi et al. | |
| 7,603,049 | B2 | 10/2009 | Kishi et al. | |
| 7,609,988 | B2 | 10/2009 | Kishi et al. | |
| 7,664,450 | B2 | 2/2010 | Aze et al. | |
| 2002/0175795 | A1* | 11/2002 | Fuseya et al. | 336/90 |
| 2003/0170055 | A1* | 9/2003 | Terada et al. | 399/328 |
| 2004/0037597 | A1* | 2/2004 | Haseba et al. | 399/328 |
| 2004/0136761 | A1* | 7/2004 | Asakura et al. | 399/328 |
| 2006/0051111 | A1 | 3/2006 | Kishi et al. | |
| 2007/0014599 | A1* | 1/2007 | Yasuda et al. | 399/328 |
| 2008/0267676 | A1* | 10/2008 | Takai et al. | 399/335 |
| 2009/0175644 | A1* | 7/2009 | Nanjo et al. | 399/69 |
| 2009/0175664 | A1* | 7/2009 | Nanjo et al. | 399/330 |
| 2009/0245897 | A1* | 10/2009 | Seo et al. | 399/328 |
| 2009/0245898 | A1* | 10/2009 | Gon et al. | 399/328 |
| 2010/0028061 | A1* | 2/2010 | Nanjo et al. | 399/328 |
| 2010/0215414 | A1* | 8/2010 | Uchiyama et al. | 399/329 |
| 2010/0272483 | A1* | 10/2010 | Nanjo | 399/331 |
| 2011/0052284 | A1* | 3/2011 | Yonekawa | 399/333 |
| 2011/0064502 | A1* | 3/2011 | Hase et al. | 399/406 |
| 2011/0182637 | A1* | 7/2011 | Okada | 399/333 |
| 2011/0243621 | A1* | 10/2011 | Gon | 399/328 |
| 2011/0311250 | A1* | 12/2011 | Urano | 399/45 |
| 2011/0318076 | A1* | 12/2011 | Tanda | 399/329 |
| 2012/0020710 | A1* | 1/2012 | Motoki | 399/334 |
| 2012/0057909 | A1* | 3/2012 | Gon | 399/329 |
| 2012/0093529 | A1* | 4/2012 | Kidokoro | 399/45 |
| 2012/0099909 | A1* | 4/2012 | Nanjo | 399/329 |
| 2012/0107028 | A1* | 5/2012 | Mizumo | 399/328 |
| 2012/0148318 | A1* | 6/2012 | Sugaya et al. | 399/329 |
| 2012/0155918 | A1* | 6/2012 | Egi | 399/122 |

FOREIGN PATENT DOCUMENTS

| | | |
|---|---|---|
| JP | 2006-284649 | 10/2006 |
| JP | 2007-304315 | 11/2007 |
| JP | 2009-14972 | 1/2009 |

* cited by examiner

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application Nos. 2011-002890, filed on Jan. 11, 2011 and 2011-266049, filed on Dec. 5, 2011, both in the Japan Patent Office, which are hereby incorporated herein by reference in their entirety.

BACKGROUND OF THE INVENTION

1. Field of the Invention

Exemplary aspects of the present invention generally relate to a fixing device and an image forming apparatus, such as a copier, a facsimile machine, a printer, or a multi-function system including a combination thereof, and more particularly, to a fixing device using an electromagnetic induction heating method and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical scanner projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

Fixing devices that use an electromagnetic induction heating method to reduce a warm-up time (the time it takes the fixing device to reach a target temperature) of the image forming apparatus, thereby conserving energy, are known, such as JP-2009-14972-A. One example of such a fixing device using the induction heating method is equipped with a support roller (a heating roller) serving as a heat generating body, a fixing auxiliary roller (fixing roller), a fixing belt, an induction heater, and a pressing roller. The fixing belt is formed into a loop and wound around the support roller and the fixing auxiliary roller. The pressing roller contacts the fixing auxiliary roller via the fixing belt. The induction heater is disposed opposite the support roller via the fixing belt, and consists of a coil portion including an excitation coil, a core (excitation coil core) facing the coil portion, and a holder that holds parts such as the coil portion and the core. The excitation coil is wound longitudinally around the induction heater.

As the fixing belt rotates and comes to face the induction heater, the fixing belt is heated by the induction heater. Subsequently, the heated fixing belt heats a toner image on a recording medium at a fixing nip where the fixing auxiliary roller and the pressing roller meet and press against each other and through which the recording medium sheet is conveyed, thereby fixing the toner image onto the recording medium. More specifically, an alternating magnetic field is formed around the coil portion by supplying a high-frequency alternating current thereto. As a result, an eddy current is generated near the surface of the support roller, generating Joule heat through the electrical resistance of the support roller itself, which in turn heats the fixing belt wound around the support roller, accordingly.

In this configuration, the heat generating body is directly heated by electromagnetic induction, hence providing high heat conversion efficiency compared with other known heating methods such as those employing a halogen heater. The electromagnetic induction heating method can heat the surface of the fixing belt to a desired temperature (fixing temperature) quickly with little power.

Another example of a known fixing device using the electromagnetic induction heating method (JP-3519401-B) includes a core (i.e. back surface core) disposed opposite an excitation coil consisting of a C-type core and a center core to enhance heat generating efficiency.

Generally, in the fixing device using the electromagnetic induction heating method, a magnetic circuit needs to be closed to prevent generation of leakage flux from the coil for efficient induction heating. A known technique to close the magnetic circuit includes adding a ferrite core, a shield, or the like. The fixing device using the C-type core and the center core disposed opposite the excitation coil may enhance the heat generating efficiency of the heat generating member. However, the heat generating efficiency may not be sufficient.

In the known fixing devices described above, the heating member and the magnetic core that directs the magnetic flux from the excitation coil to the heat generating member are relatively widely separated, resulting in a longer time to bring the heat generating member to a desired temperature. In other words, the warm-up time of the fixing device is lengthened.

In view of the above, there is demand for an induction heating-type fixing device with good heating efficiency and a short warm-up time.

BRIEF SUMMARY OF THE INVENTION

In view of the foregoing, in an aspect of this disclosure, an induction heating-type fixing device includes a fixing member, an excitation coil, a magnetic core, a holder, and a pressing member. The fixing member includes a heat generating layer to heat and fuse a toner image on a recording medium. The excitation coil wound a predetermined number of times is disposed facing an outer surface of the fixing member, to generate a magnetic flux relative to the fixing member. The magnetic core forms a continuous magnetic path to direct the magnetic flux generated by the excitation coil to the fixing member. The holder holds the excitation coil and the magnetic core. The pressing member is disposed opposite the fixing member to press against the fixing member and form a fixing nip between the fixing member and the pressing member through which the recording medium is conveyed. The magnetic core is exposed from the holder at the fixing member side.

According to another aspect, an induction heating-type fixing device includes a fixing member, an excitation coil, a magnetic core, a holder, and a pressing member. The fixing member includes a heat generating layer to heat and fuse a toner image on a recording medium. The excitation coil wound a predetermined number of times is disposed facing an outer surface of the fixing member, to generate a magnetic flux relative to the fixing member. The magnetic core forms a continuous magnetic path to direct the magnetic flux generated by the excitation coil to the fixing member. The holder holds the excitation coil and the magnetic core. The pressing member is disposed opposite the fixing member to press against the fixing member and form a fixing nip between the fixing member and the pressing member through which the recording medium is conveyed. The magnetic core is embedded in a wall of the holder.

The aforementioned and other aspects, features and advantages would be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
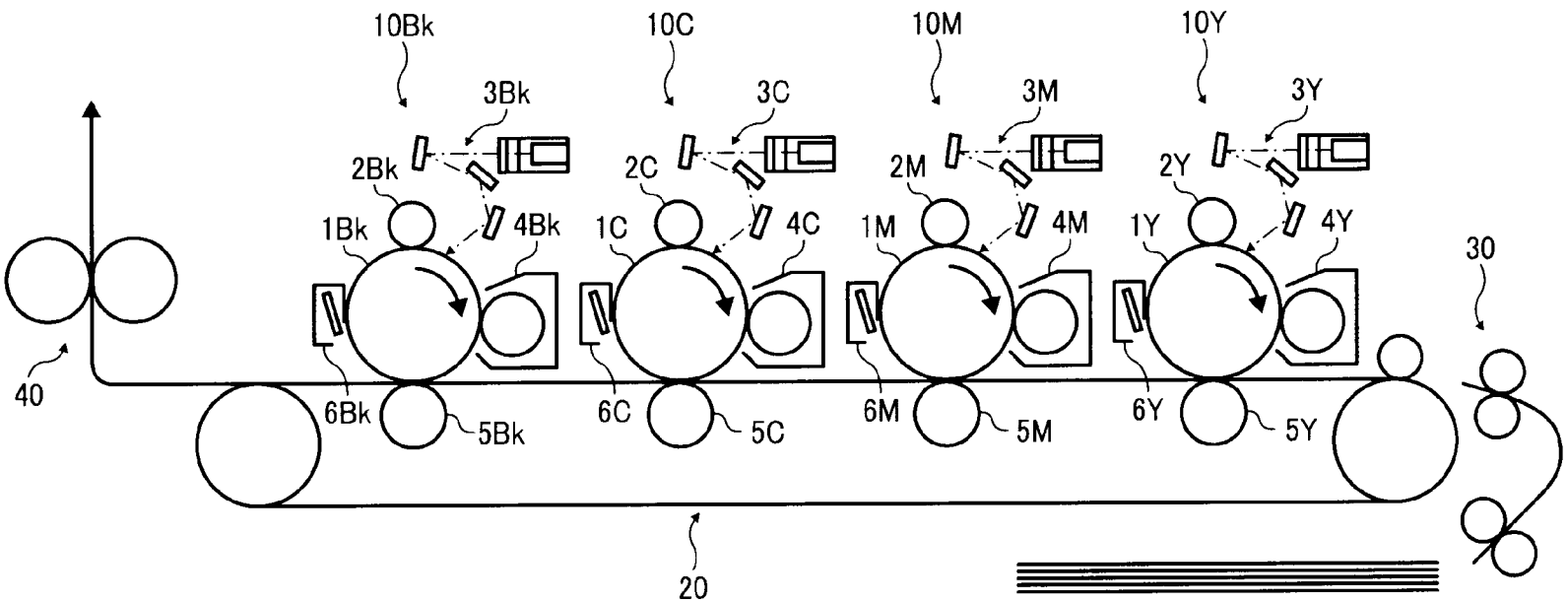
FIG. 1 is a schematic diagram illustrating an image forming apparatus according to an illustrative embodiment.

A description is now given of illustrative embodiments. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present application.

In addition, it should be noted that the terminology used herein is for the purpose of describing particular embodiments only and is not intended to be limiting of the present disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially with reference to FIG. 1, a description is provided of an image forming according to an aspect of this disclosure.

With reference to FIG. 1, a description is provided of a configuration and operation of a printer as an example of the image forming apparatus, according to an illustrative embodiment. FIG. 1 is a schematic diagram illustrating the image forming apparatus.

As illustrated in FIG. 1, the image forming apparatus includes four electrophotographic image forming stations 10Y, 10M, 10C, and 10Bk, each serving as an image forming mechanism for forming toner images of yellow, magenta, cyan, and black, respectively. It is to be noted that the suffixes Y, M, C, and Bk denote colors yellow, magenta, cyan, and black, respectively. To simplify the description, these suffixes are omitted herein, unless otherwise specified. The image forming stations 10Y, 10M, 10C, and 10Bk include photoconductive drums 1Y, 1M, 1C, and 1Bk, respectively.

The image forming stations 10Y, 10M, 10C, and 10Bk, one for each of the colors yellow, magenta, cyan, and black are arranged in tandem contacting a conveyance belt 20 for conveying a recording medium such as a sheet of paper. The conveyance belt 20 is disposed below the image forming stations 10. The recording medium adheres electrostatically to the surface of the conveyance belt 20.

It is to be noted that the image forming stations 10Y, 10M, 10C, and 10Bk all have the same configuration as all the others, differing only in the color of toner employed. Thus, a description is provided only of the image forming station 10Y for yellow disposed at the extreme upstream end in a direction of conveyance of the recording medium as a representative example of the image forming stations 10.

The image forming station 10Y includes the photoconductive drum 1Y disposed substantially at the center of the image forming station 10Y. The photoconductive drum 1Y contacts the conveyance belt 20 while rotating. The photoconductive drum 1Y is surrounded by various pieces of imaging equipment, such as a charging device 2Y, an exposure device 3Y, a developing device 4Y, a transfer roller 5Y, a drum cleaner 6Y, and a charge neutralizing device (not illustrated). The charging device 2Y charges the surface of the photoconductive drum 1Y at a certain electric potential. The exposure device 3Y illuminates the charged surface of the photoconductive drum 1Y with light based on an image signal after color separation, thereby forming an electrostatic latent image on the surface of the photoconductive drum 1Y. The developing device 4Y develops the electrostatic latent image on the surface of photoconductive drum 1Y with toner of yellow, thereby forming a visible image, also known as a toner image of yellow. The transfer roller 5Y transfers the developed toner image onto a recording medium conveyed by the conveyance belt 20. The drum cleaner 6Y removes residual toner remaining on the surface of the photoconductive drum 1Y after transfer process. The charge neutralizing device is disposed along the direction of rotation of the photoconductive drum 1Y to remove residual charge on the photoconductive drum 1Y.

In FIG. 1, a sheet supplying unit 30 for supplying the recording medium onto the conveyance belt 20 is provided at the bottom right of the conveyance belt 20. The sheet supplying unit 30 includes various pieces of equipment such as rollers for conveying the recording medium to the conveyance belt 20.

At the left of the conveyance belt 20, a fixing device 40 according to an illustrative embodiment is provided. A detailed description of the fixing device 40 is provided with reference to FIG. 2 and subsequent drawings. Thus, in FIG. 1, various pieces of equipment such as an excitation coil employed in the fixing device 40 are omitted. The recording medium carried on the conveyance belt 20 is conveyed to the fixing device 40 via a conveyance path extending continuously from the conveyance belt 20. The recording medium passes through the fixing device 40.

In the fixing device 40, heat and pressure are applied to the recording medium bearing the toner image, thereby fusing and pressing the toner image onto the recording medium. Accordingly, the toner image is fixed on the recording medium. Subsequently, the recording medium is discharged outside the image forming apparatus via sheet discharge rollers disposed downstream from the conveyance path of the fixing device 40. A sequence of imaging cycle is completed.

Figure 2:
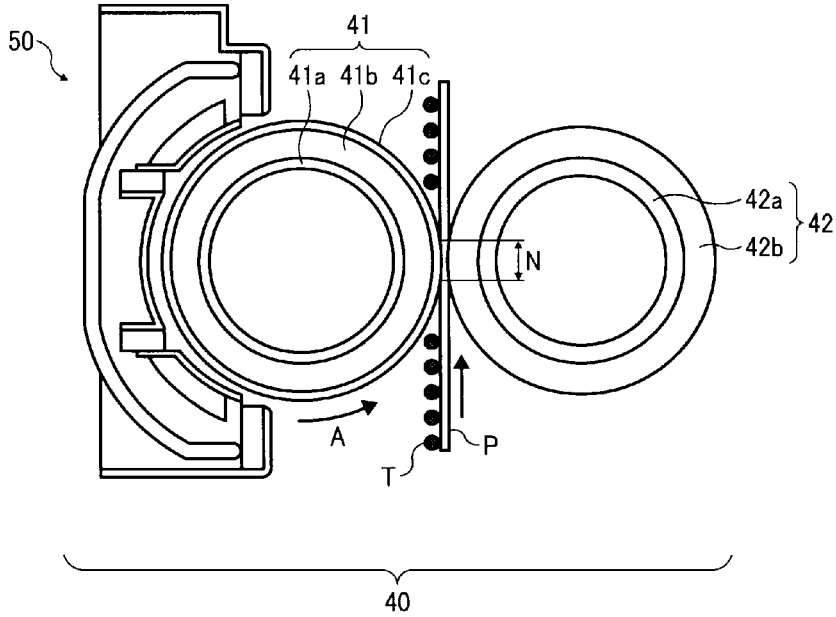
FIG. 2 is a cross-sectional diagram schematically illustrating a fixing device employed in the image forming apparatus of FIG. 1 according to a first illustrative embodiment.

Next, with reference to FIG. 2, a detailed description is provided of the fixing device 40 of the image forming apparatus. FIG. 2 is a cross-sectional view schematically illustrating the fixing device 40, according to a first illustrative embodiment of the present invention.

As illustrated in FIG. 2, the fixing device 40 includes an induction heater 50 serving as a magnetic flux generator, a fixing roller 41 serving as a heat generating member and also as a fixing member, a pressing roller 42, and so forth. The fixing roller 41 serving as a heat generating member has a multilayer structure constructed of a hollow metal core 41*a* on which an elastic layer 41*b* and a heat generating layer 41*c* are provided. The hollow metal core 41*a* is formed of metal such as stainless steel and carbon steel. More specifically, the fixing roller 41 has an outer diameter in a range of from approximately 30 mm to 40 mm. The elastic layer 41*b* is provided on the metal core 41*a*. The heat generating layer 41*c* is provided on the elastic layer 41*b*.

The metal core 41*a* is made of a stainless steel, for example, SUS304 or the like formed into a cylinder or a solid tube. The thickness thereof is approximately 1 mm. As the elastic layer 41*b*, a solid or foam heat-resistant silicone rubber or the like is used to cover the metal core 41*a*. The thickness of the elastic layer 41*b* is in a range of from approximately 3 mm to 10 mm. The hardness thereof is in a range from 10° to 50° according to JIS-A.

The heat generating layer 41*c* is constructed of a base layer, a main heat generating layer, an elastic layer and a release layer, in that order from the inner side of the heat generating layer 41*c*. The base material of the heat generating layer 41*c* is nickel (Ni) and has a thickness in a range of from approximately 3 μm to 15 μm, thereby enhancing a heat generating efficiency. Alternatively, SUS or a magnetic shunt alloy having a Curie point in a range of from 160° C. to 220° C. may be used as the heat generating layer 41*c*. An aluminum member may be disposed inside the magnetic shunt alloy, thereby stopping the temperature from rising near the Curie point. Polyimide may be employed for the base layer. With this configuration, the heat capacity of the heat generating layer is less than when using metal in the base material, thereby reducing energy to increase the temperature.

The main heat generating layer of the heat generating layer 41*c* is made of copper (Cu) and has a thickness equal to or less than 5 μm. For prevention of oxidation, a nickel (Ni) layer may be provided on the surface of the copper (Cu) layer. The elastic layer of the heat generating layer 41*c* is formed of silicone rubber and has a thickness in a rage of from 100 μm to 500 μm. The elastic layer enhances adhesion of the fixing roller 41 with respect to the recording medium.

The release layer of the heat generating layer 41*c* is made of a fluorine compound such as perfluoroalkoxy polymer resin (PFA) and has a thickness in a rage of from 10 μm to 100 μm. The release layer enhances releasability of the surface of the fixing roller 41 that contacts directly the toner image T.

According to the first illustrative embodiment, the fixing roller 41 serves as a fixing member that melts the toner image and also serves as a heat generating member that is heated directly by the induction heater 50.

In the present embodiment, the base material of the heat generating layer 41*c* is a single layer of magnetic metal. The magnetic metal that forms the heat generating layer may include nickel (Ni) having a thickness of approximately 10 μm. Alternatively, iron, cobalt, copper, or alloys thereof may be used.

The pressing roller 42 is constructed of a cylinder member 42*a* made of metal including, but not limited to, aluminum and copper. An elastic layer 42*b* is provided on the cylinder member 42*a*. The elastic layer 42*b* is formed of rubber material such as fluorocarbon rubber and silicone rubber. The elastic layer 42*b* of the pressing roller 42 has a thickness in a range of from approximately 0.5 mm to 2 mm and a hardness thereof in a range of from 20° to 50° on the Asker C scale. The pressing roller 42 contacts and presses against the fixing roller 41. The recording medium passes through the fixing nip N between the fixing roller 41 and the pressing roller 42.

Figure 3A:
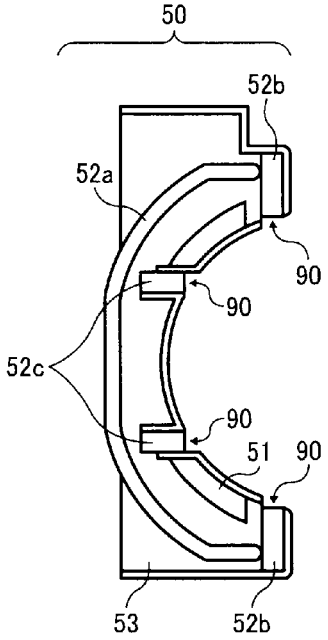
FIG. 3A is a cross-sectional view schematically illustrating an induction heater employed in the fixing device of FIG. 2.
Figure 3B:
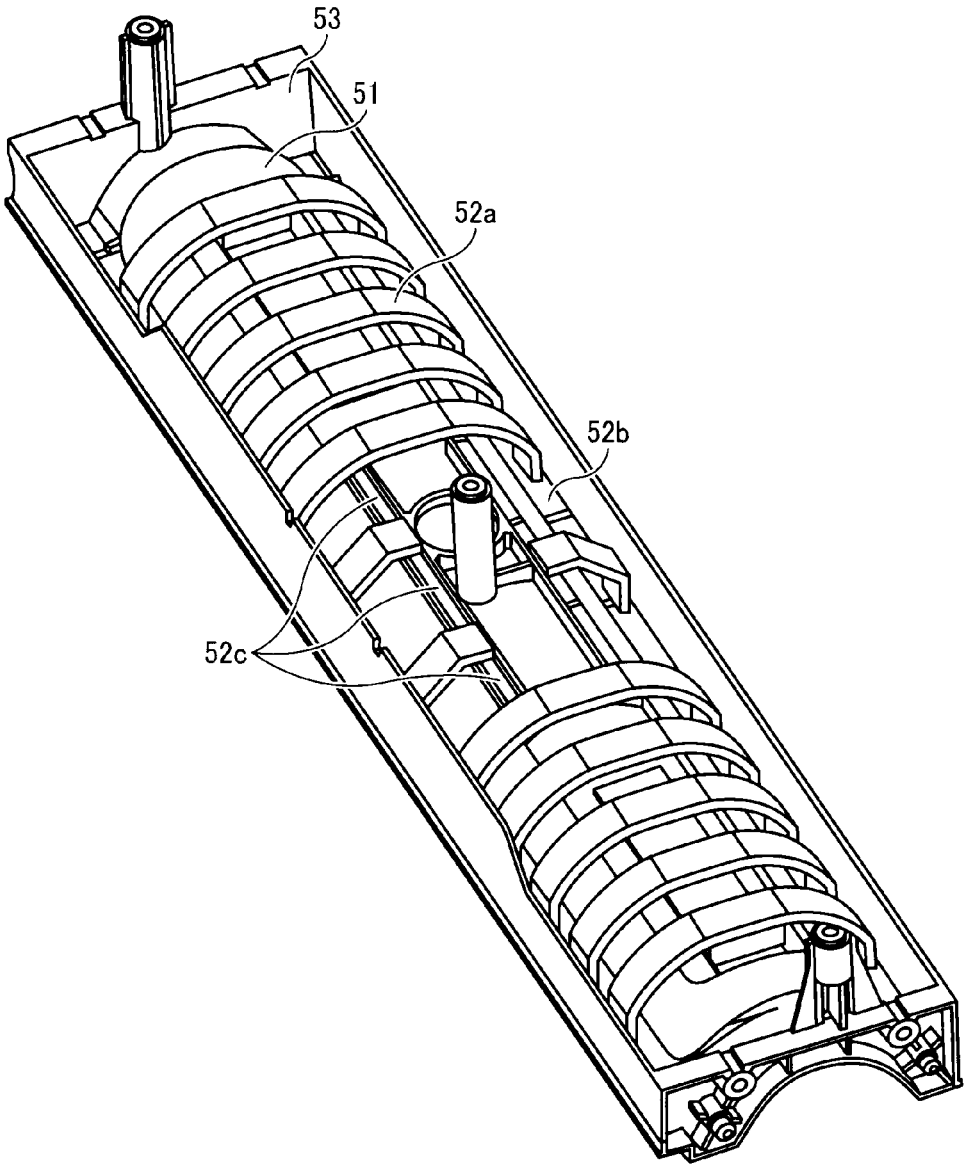
FIG. 3B is a perspective view schematically illustrating the back of a holder of the induction heater where an excitation coil and a magnetic coil are disposed.

With reference to FIGS. 3A and 3B, a description is provided of the induction heater 50 according to the first illustrative embodiment of the present invention. FIG. 3A is a cross-sectional view schematically illustrating the induction heater 50 employed in the fixing device 40. FIG. 3B is a perspective view schematically illustrating the back of a holder 53 of the induction heater 50 where an excitation coil 51, a magnetic core 52 and so forth are disposed. The induction heater 50 is disposed facing the outer circumferential surface of the fixing roller 41. As illustrated in FIG. 3A, the induction heater 50 includes the holder 53 that holds the excitation coil 51, an arch core 52*a*, a side core 52*b*, and a center core 52*c*. The arch core 52*a*, the side core 52*b*, and the center core 52*c* are hereinafter collectively referred to as the magnetic core 52, unless otherwise specified.

The excitation coil 51 includes Litz wire consisting of strands of 50 to 500 pieces of wire, each wire having ϕ in a range of from approximately 0.05 mm to 0.2 mm and insulated electrically from each other. Such Litz wire is wound about 5 times to 15 times. In the holder 53 the excitation coil 51 extends across an entire area of a maximum heating region of the fixing roller 41 and generates an interlinkage magnetic flux relative to the fixing roller 41. On the surface of Litz wire, a fusing layer is provided. The fusing layer is solidified by the Joule heating or when heated in a thermostat chamber so that the shape of the wound coil is maintained. Alternatively, the Litz wire without the fusing layer may be wound and pressure-molded, thereby keeping its shape reliably. The Litz wire needs to be resistant to heat at a temperature equal to or more than the fixing temperature. Hence, the insulating material for a wire strand of the Litz wire includes, but is not limited to, both heat-resistant and insulating resin such as polyamide-imide resin and polyimide resin.

The excitation coil 51 consisting of multiple-wound Litz wire is adhered to the holder 53 using an adhesive agent, for example, a silicone adhesive agent. The holder 53 also needs to be resistant to heat at the temperature equal to or greater than the fixing temperature. Thus, the material for the holder 53 includes, but is not limited to, a highly heat-resistant resin such as polyethylene terephthalate (PET), polyphenylene sulfide (PPS), and liquid crystal polymer (LCP). The excitation coil 51 is held by a surface of the holder 53 facing the fixing roller 41. In order to satisfy product safety standards, insulating properties in accordance with Systems of Insulating Materials UL1446, and moldability of resin, the holder 53 needs to have a certain thickness. In view of this, because liquid crystal polymer is tolerant to heat and has good insulating properties as well as moldability, liquid crystal polymer (LCP) is employed according to the illustrative embodiment of the present invention.

As described above, the magnetic core 52 consists of the arch core 52*a*, the side core 52*b*, and the center core 52*c*. As illustrated in FIG. 3A, the arch core 52*a* is disposed opposite the outer circumferential surface of the fixing roller 41 via the excitation coil 51. The side core 52*b* is disposed at the excitation coil side facing the outer circumferential surface of the fixing roller 41 and contacts the arch core 52*a*. The center core 52*c* is disposed in the center of the excitation coil 51. With this configuration, a closed magnetic path which directs the magnetic flux from the excitation coil 51 to the fixing roller 41 is formed by the magnetic core 52 surrounding the excitation coil 51. The magnetic circuit is reliably closed, thereby enhancing the heat generating efficiency of the fixing roller 41.

As illustrated in FIGS. 3A and 3B, the side core 52*b* and the center core 52*c* are exposed from the holder 53 at the fixing roller side. More particularly, the wall of the holder 53 has a notch 90 through which the side core 52*b* and the center core 52*c* are inserted from outside or inside of the holder 53 and adhered thereto using some form of adhesive. Accordingly, the side core 52*b* and the center core 52*c* are exposed from the wall of the holder 53 so that the side core 52*b* and the center core 52*c* are near the fixing roller 41.

Figure 18:
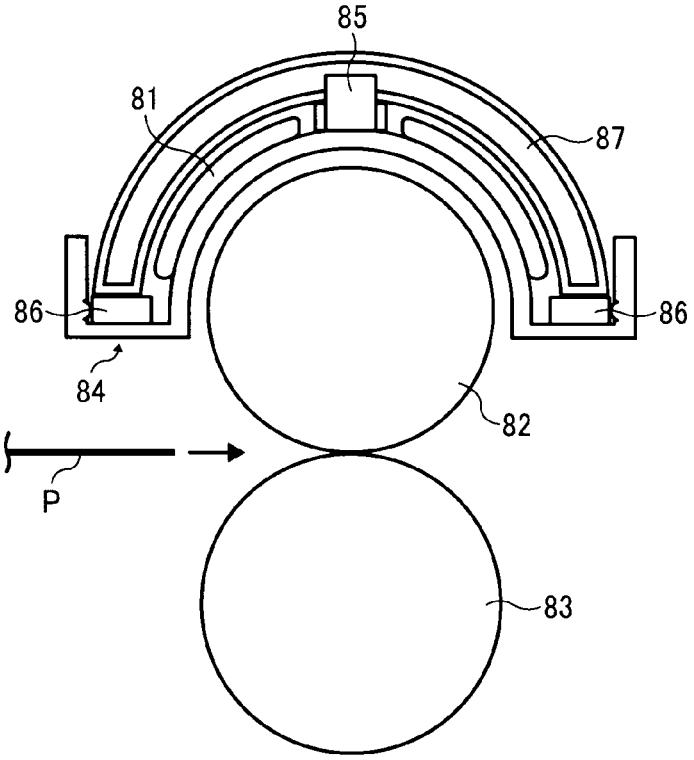
FIG. 18 RELATED ART
FIG. 18 is a cross-sectional view schematically illustrating a related-art fixing device.

By contrast, in a related-art induction heater as illustrated in FIG. 18, a side core 86 and a center core 85 can only extend up to the inner side of the wall of a coil guide 84 (equivalent of the holder 53). FIG. 18 is a cross-sectional view schematically illustrating the related-art induction heater. According to the illustrative embodiment, however, the side core 52*b* and the center core 52*c* are exposed from the wall of the holder 53 so that these cores are substantially near the fixing roller 41. This configuration allows the side core 52*b* and the center core 52*c* to be close to the fixing roller 41. With this configuration, the magnetic path that directs the magnetic flux from the excitation coil 51 to the fixing roller 41 can be formed close to the fixing roller 41, thereby enhancing the heat generating efficiency of the fixing roller 41 while reducing the warm-up time and saving energy.

The material for the arch core 52*a*, the side core 52*b*, and the center core 52*c* includes, but is not limited to, soft magnetic material and yet highly electrically resistant such as Mn—Zn ferrites and Ni—Zn ferrites. The magnetic core 52 is made through compression molding in which powder material is compressed in a mold cavity where heat and pressure are applied to sinter. During sinter process, the magnetic core 52 shrinks. Thus, if the shape of the magnetic core 52 is complicated and shrinks during sinter process, the magnetic core 52 deforms or bends in a complicated manner, complicating the resulting shape. For this reason, preferably, the magnetic core 52 has a simple shape.

The arch core 52*a*, the side core 52*b*, and the center core 52*c* are individual parts and assembled together during assembly. Accordingly, each core can have a simple shape, thereby facilitating assembly and hence reducing the manufacturing cost.

Figure 4:
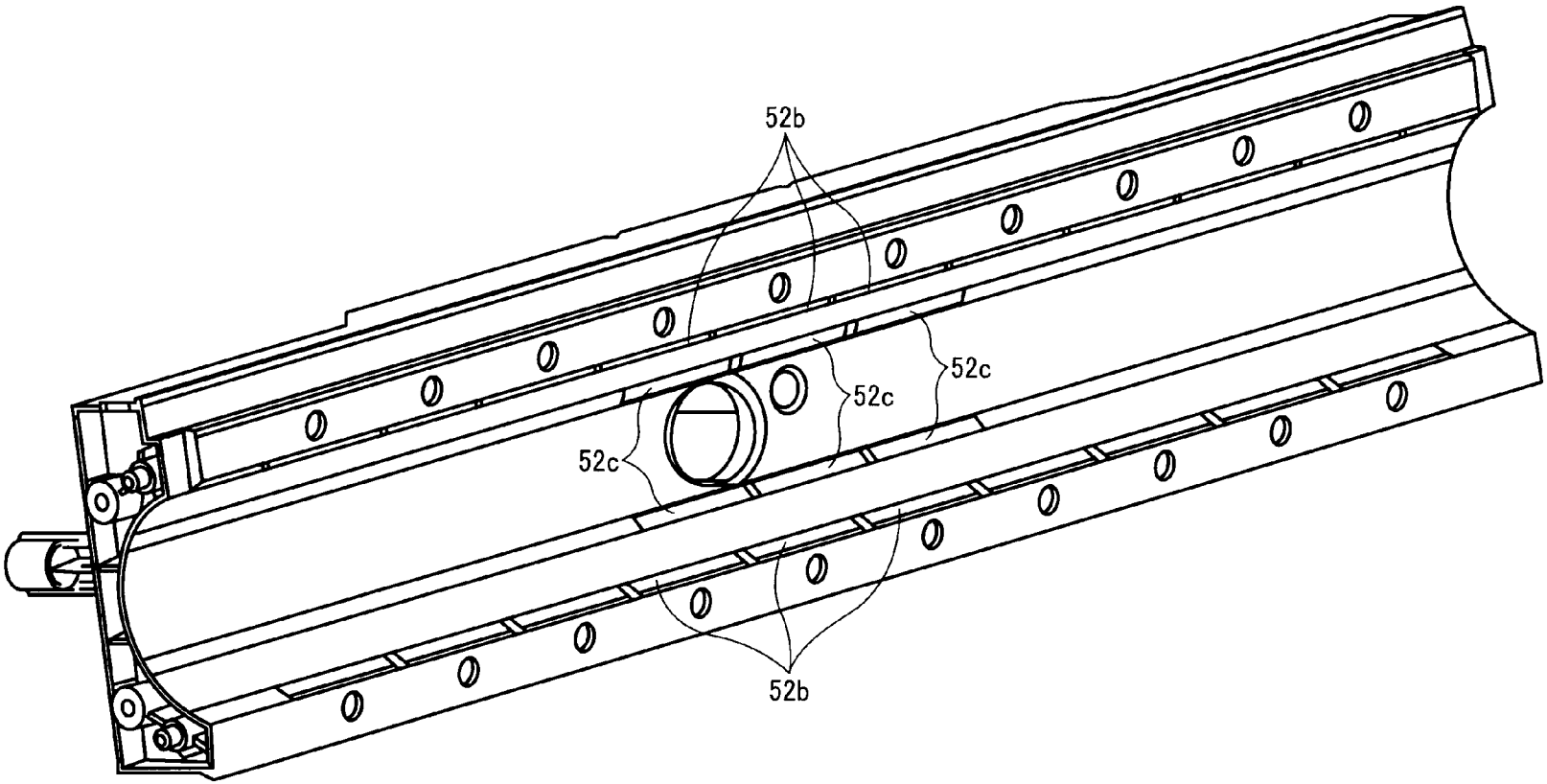
FIG. 4 is a perspective view schematically illustrating the front side of the holder as viewed from a fixing roller side with the magnetic core adhered to the holder.

Referring now to FIG. 4, there is provided a perspective view schematically illustrating the front side of the holder 53 as viewed from the fixing roller side when the magnetic core 52 is adhered to the holder 53 using some form of adhesive.

As viewed from the fixing roller side, the side cores 52*b* and the center cores 52*c* are exposed from the holder 53. The surface of the side cores 52*b* and the center cores 52*c* facing the fixing roller 41 is substantially near the fixing roller 41. The center of the holder 53 is curved inward to accommodate the shape of the surface of the fixing roller 41. The width of the exposed portion of the side core 52*b* and the center core 52*c* in the longitudinal direction of the holder 53 is not limited to the illustrative embodiment shown in the drawings. As will be later described with reference to FIG. 5, the width of the exposed portion may be determined arbitrarily by adjusting the width of ribs 55 and 56 provided to the holder 53 as reinforcing members to maintain the strength of the holder 53 and to separate the side cores 52*b* and the center cores 52*c*.

Figure 5:
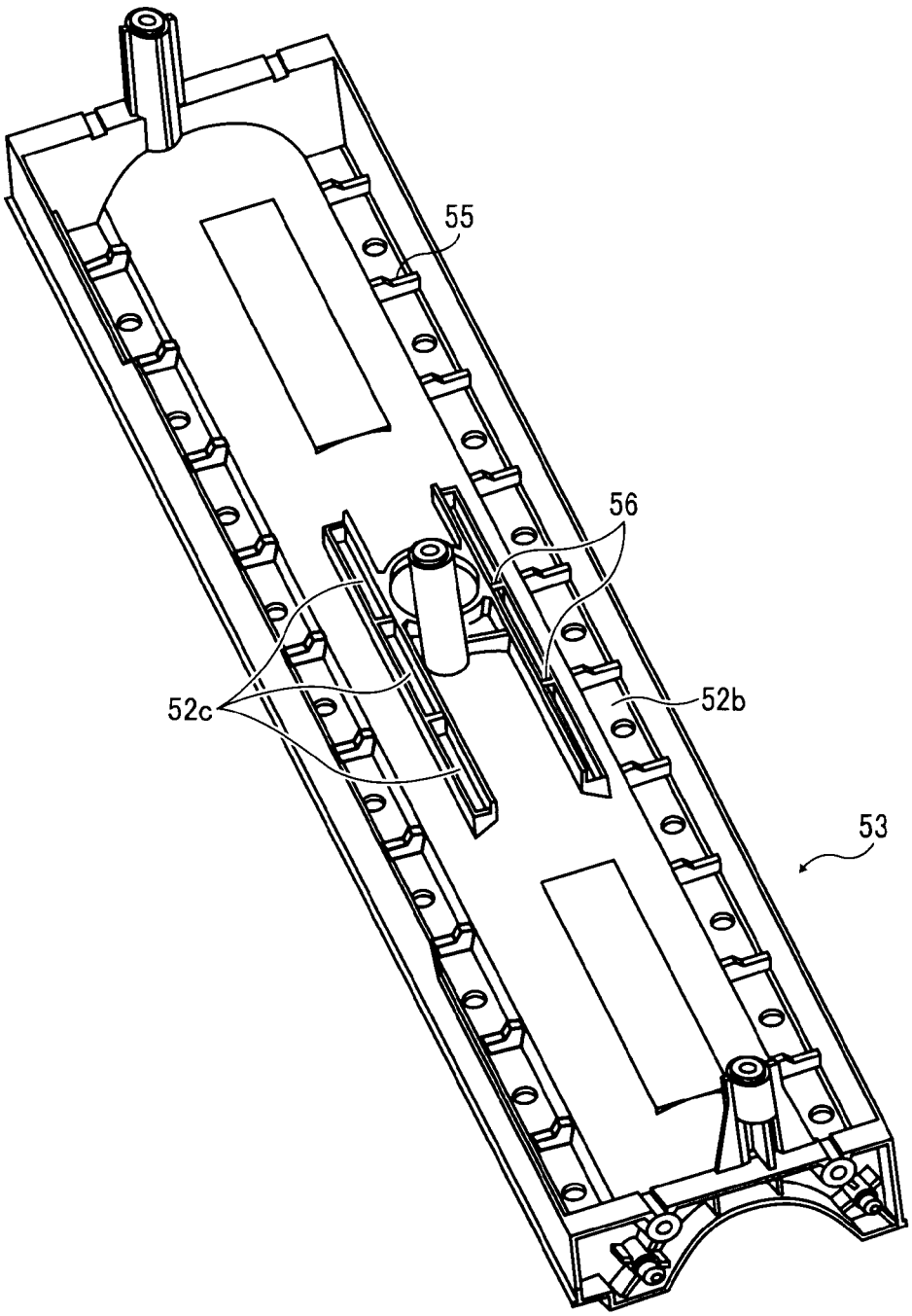
FIG. 5 is a perspective view schematically illustrating the back of the holder with the excitation coil and the magnetic core removed from the holder.

With reference to FIG. 5, a description is provided of the back of the holder 53 in a state in which the excitation coil 51 and the arch cores 52*a* are removed from the holder 53. FIG. 5 is a perspective view schematically illustrating the back of the holder 53 without the excitation coil 51 and the arch cores 52*a*. As illustrated in FIG. 3B, a plurality of arch cores 52*a*, here, 10 pieces of arch cores 52*a*, are disposed with a predetermined interval between each other across the holder 53 within an area substantially equal to the width of the fixing roller 41. Similarly, as illustrated in FIG. 5, a plurality of side cores 52*b*, here, 20 pieces of side cores 52*b*, are disposed discontinuously at sides of the holder 53 across the holder 53 in the longitudinal direction thereof. The side cores 52*b* are spaced apart a certain distance and separated by ribs 55 serving as a reinforcing member. The ribs 55 are each disposed between the side cores 52*b*. The rib 55 extends in a direction perpendicular to the longitudinal direction of the holder 53.

A plurality of center cores 52*c*, here, 6 pieces of center cores 52*c*, are disposed discontinuously at the center of the holder 53 in the longitudinal direction thereof. The center cores 52*c* are spaced apart a certain distance and separated by ribs 56 serving as a reinforcing member. The ribs 56 are each disposed between the center cores 52*c*. The strength of the holder 53 is degraded when the notches 90 are formed in the wall of the holder 53 to insert the side cores 52*b* and the center cores 52*c*. In view of this, the ribs 55 and 56 are provided to the holder 53 to reinforce the strength of the holder 53. In FIG. 5, the center cores 52*c* are disposed at the portion of the holder 53 curved outward corresponding to the cylindrical fixing roller 41. Thus, the position of the center cores 52*c* is higher than the side cores 52*b*.

Figure 6A:
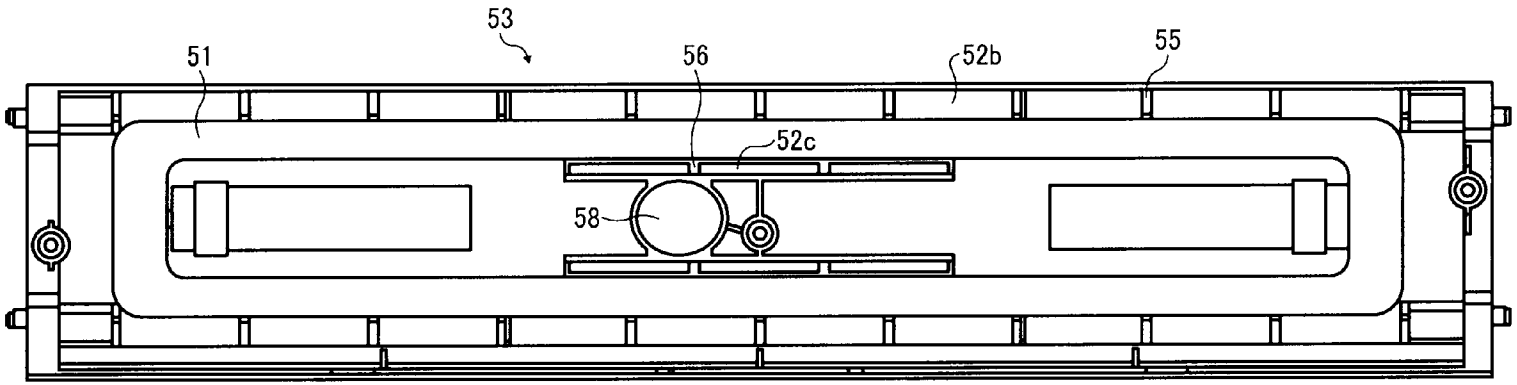
FIG. 6A is a plan view schematically illustrating the back of the holder without an arch core.
Figure 6B:
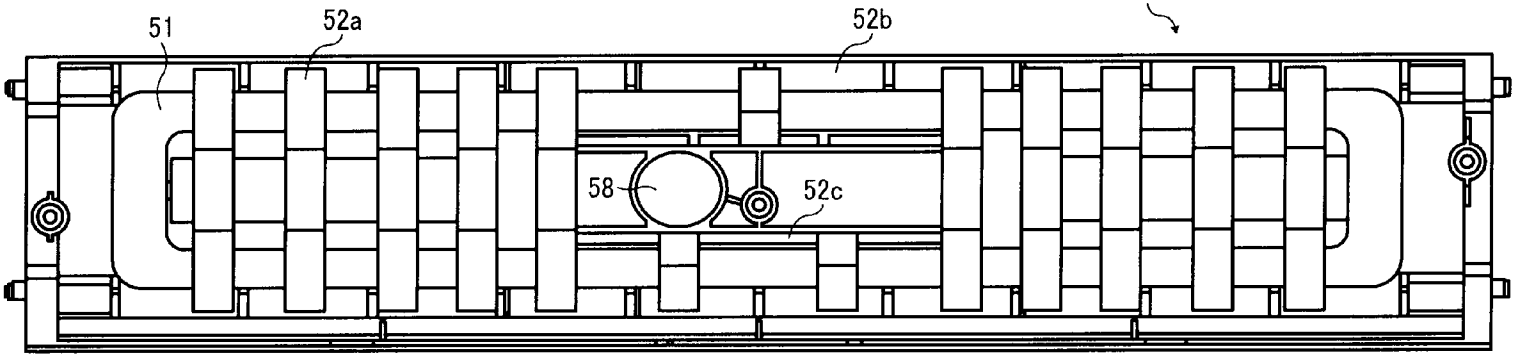
FIG. 6B is a plan view schematically illustrating the back of the holder with the arch core attached thereto.

With reference to FIGS. 6A and 6B, a description is provided of the back of the holder 53 when the arch cores 52*a* are removed from the holder 53. FIG. 6A is a plan view schematically illustrating the back of the holder 53 without the arch cores 52*a*; whereas, FIG. 6B is a plan view schematically illustrating the back of the holder 53 including the arch cores 52*a* attached thereto. As illustrated in FIG. 6A, a plurality of the ribs 55 and 56 are formed on the holder 53. The ribs 55 are each disposed between the side cores 52*b*. The ribs 56 are each disposed between the center cores 52*c*.

According to the illustrative embodiment, the holder 53 includes both the ribs 55 and the ribs 56. Alternatively, the holder 53 may include either the ribs 55 or the ribs 56 to reinforce the holder 53. As illustrated in FIG. 6B, the arch cores 52*a* are disposed from the center to the end portion of the induction heating portion and contact the side cores 52*b*. As illustrated in FIGS. 6A and 6B, an opening 58 is provided substantially at the center of the holder 53 to accommodate a temperature detector. Alternatively, however, the opening 58 may be eliminated. The arch cores 52*a* are curved (arch-shaped) to accommodate the shape of the outer circumferential surface of the fixing roller 41.

As described above, the ribs 55 and 56 provided inside the holder 53 can reinforce the strength of the holder 53 even when the notches 90, from which the side cores 52*c* and the center cores 52*c* are inserted, are formed in the holder 53 to expose the side cores 52*b* and the center cores 52*c* from the holder 53. It is to be noted that the side cores 52*b* and the center cores 52*c* are exposed from the holder 53 as viewed from the fixing roller side. However, other cores are not exposed from the holder 53.

According to the first illustrative embodiment, the side cores 52*b* and the center cores 52*c* are adhered to the holder 53 using some form of adhesive. This facilitates assembly and reduces a number of assembly steps and the associated cost. An adhesive agent, for example, a silicone adhesive agent may be used. Alternatively, a heat-resistant adhesive tape may be used to fix the side cores 52*b* and the center cores 52*c* to the holder 53.

It is known that separation of the side cores 52*b* and the center cores 52*c* from one another does not degrade magnetic coupling and heat generating efficiency as compared with continuously disposing the side cores 52*b* and the center cores 52*c* in the longitudinal direction of the holder 53. According to the first illustrative embodiment, the width of the ribs is approximately 2 mm. However, the width is not limited to 2 mm. By increasing the width of the ribs, the number of cores can be reduced, thereby reducing the cost.

Referring back to FIG. 2, a description is provided of operation of the fixing device 40 employing the above-described induction heater 50.

As the fixing roller 41 is rotated in a counterclockwise direction by a drive motor, the pressing roller 42 rotates in the clockwise direction. The fixing roller 41 serving as a fixing member is heated by the magnetic flux generated by the induction heater 50 when the fixing roller 41 comes to face the induction heater 50. More specifically, a high-frequency alternating current in a range of from 20 kHz to 1 MHz (preferably, in a range of from 20 kHz to 100 kHz) is supplied to the excitation coil 51 from a power source. Accordingly, a line of magnetic force switches alternately in both directions between the excitation coil 51 and the heat generating layer 41*c*. The fixing roller 41 is heated inductively by the heat generating layer 41*c*.

Subsequently, the surface of the fixing roller 41 heated by the induction heater 50 meets the pressing roller 42, forming the fixing nip N between the fixing roller 41 and the pressing roller 42. The recording medium P bearing the toner image T is conveyed to the fixing nip N between the pressing roller 42 and the fixing roller 41 by a guide member, and the toner image T is heated and fused in the fixing nip N, thereby fixing the toner image T onto the recording medium P. More specifically, the recording medium P bearing the toner image T subjected to imaging operation described above is guided by a guide member to the fixing nip N between the fixing roller 41 and the pressing roller 42. The toner image T is heated by both the fixing roller 41 and the pressing roller 42, and fixed reliably onto the recording medium P. After that, the recording medium P is discharged from the fixing nip N.

After the surface of the fixing roller 41 passes through the fixing nip N, the fixing roller 41 arrives at the induction heater 50 again. The sequence of fixing operation as described above is repeated, thereby completing the fixing operation in the image forming process.

Figure 7:
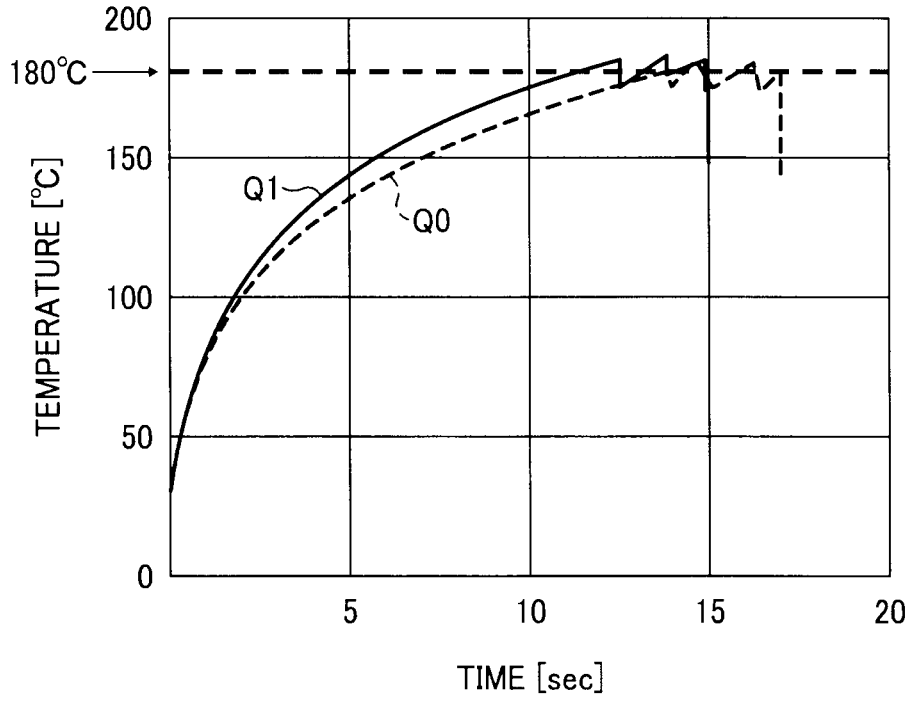
FIG. 7 is a graph showing results of an experiment in which temperature rise characteristics of the fixing device of the illustrative embodiment was compared with that of a related-art fixing device shown in FIG. 18.

With reference to FIG. 7, a description is provided of characteristics of temperature rise of the fixing device 40 of the illustrative embodiment as compared to the related-art fixing device shown in FIG. 18. FIG. 7 is a graph showing the characteristics of temperature rise of the fixing device 40 and that of the related-art fixing device. An experiment was performed to compare the characteristics of temperature rise of the fixing device 40 and the related-art fixing device.

In the experiment, the fixing device 40 was equipped with the induction heater 50 in which the side cores 52*b* and the center cores 52*c* were exposed from the holder 53. In FIG. 7, a solid line Q1 represents change in the temperature of the fixing device 40 of the first illustrative embodiment. A broken-line line Q0 represents change in the temperature of the related-art fixing device shown in FIG. 18. As illustrated in FIG. 18, the related-art fixing device includes a heating roller 82, a pressing roller 83, and an induction heater consisting of the coil guide 84 in which an excitation coil 81, the center core 85, the side core 86, and an arch core 87 are disposed. Neither the center core 85 nor the side core 86 is exposed from or embedded in the coil guide 84.

In the experiment, the temperature change of the surface of the fixing rollers was measured over time where the fixing rollers were rotated simultaneously as the power was supplied. It is to be noted that the configuration of the fixing device 40 was the same as the related-art fixing device except the induction heater. The timing at which the power was supplied at the initial stage of heating was the same for both the fixing device 40 and the related-art fixing device. Here, the warm-up time refers to a time required for the fixing roller 41 to reach a desired temperature for fixing toner (in the first illustrative embodiment, approximately 180° C.). If the warm-up time is short, a user does not have to wait for a long time. Hence it is more convenient to use.

As is understood from FIG. 7, the warm-up time of the fixing device 40 of the first illustrative embodiment was shorter than that of the related-art fixing device. More specifically, the warm-up time of the related-art fixing device to reach 180° C. was 17.4 seconds. By contrast, the warm-up time of the fixing device of the first illustrative embodiment to reach 180° C. was 12.2 seconds. The warm-up time was reduced by approximately 5 seconds. This experiment indicates that when the side cores 52*b* and the center cores 52*c* are exposed from the holder 53 so that the side cores 52*b* and the center cores 52*c* are near the fixing roller 41, the warm-up time becomes shorter than that of the related-art fixing device.

Figure 8A:
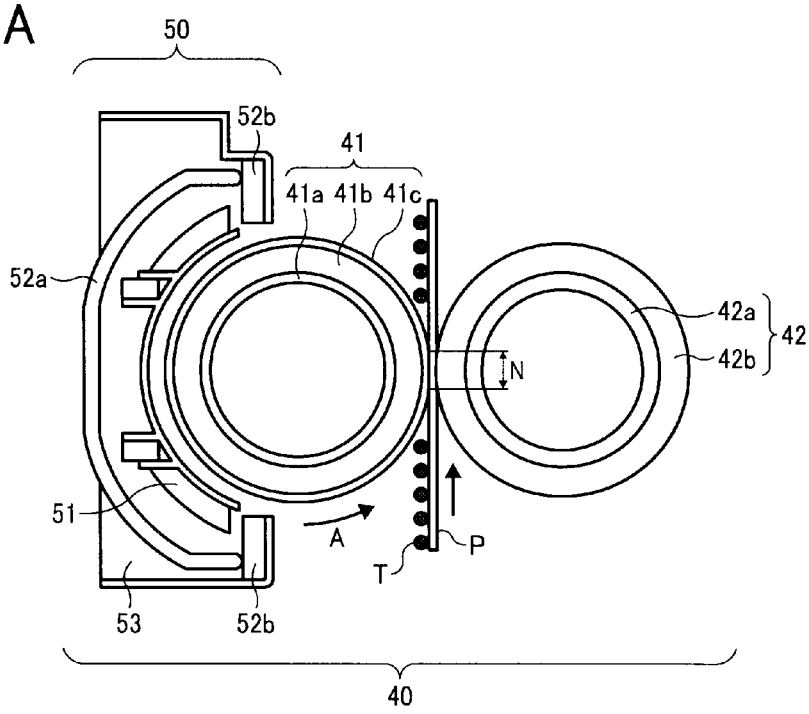
FIG. 8A is a cross-sectional view schematically illustrating the induction heater in which only a side core is exposed.
Figure 8B:
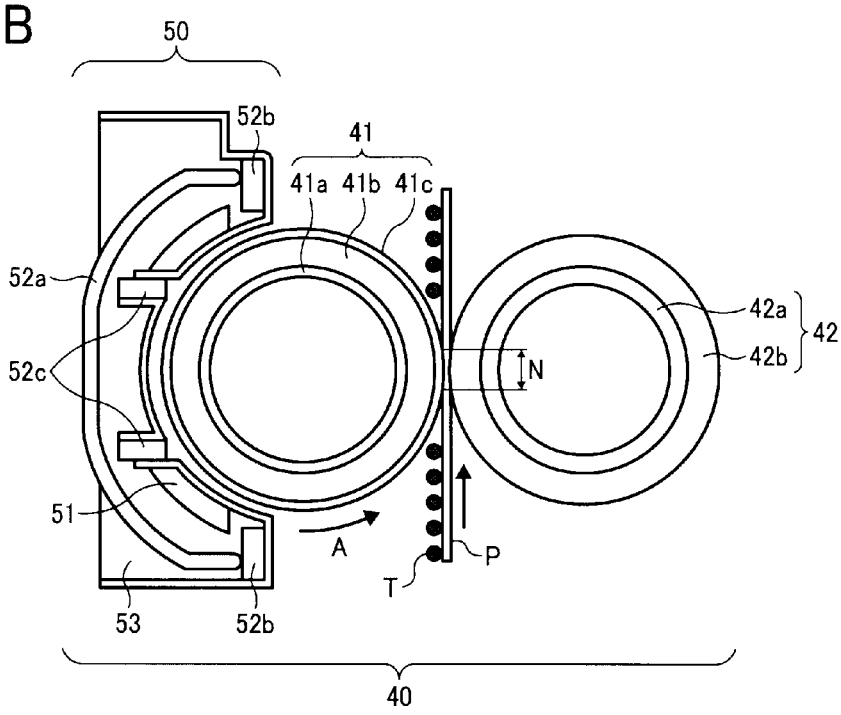
FIG. 8B is a cross-sectional view schematically illustrating the induction heater in which only a center core is exposed.

As described above, according to the first illustrative embodiment, both the side cores 52*b* and the center cores 52*c* are exposed from the holder 53 so that these cores are near the fixing roller 41. Alternatively, as illustrated in FIGS. 8A and 8B, either the side cores 52*b* or the center cores 52*c* may be exposed and disposed near the fixing roller 41. More specifically, as illustrated in FIG. 8A, only the side cores 52*b* are exposed from the holder 53. By contrast, as illustrated in FIG. 8B, only the center cores 52*c* are exposed from the holder 53. In either case, because the magnetic circuit is closed, the heat generating efficiency of the fixing roller 41 is enhanced as in the foregoing embodiments while reducing the warm-up time and saving energy.

Figure 9:
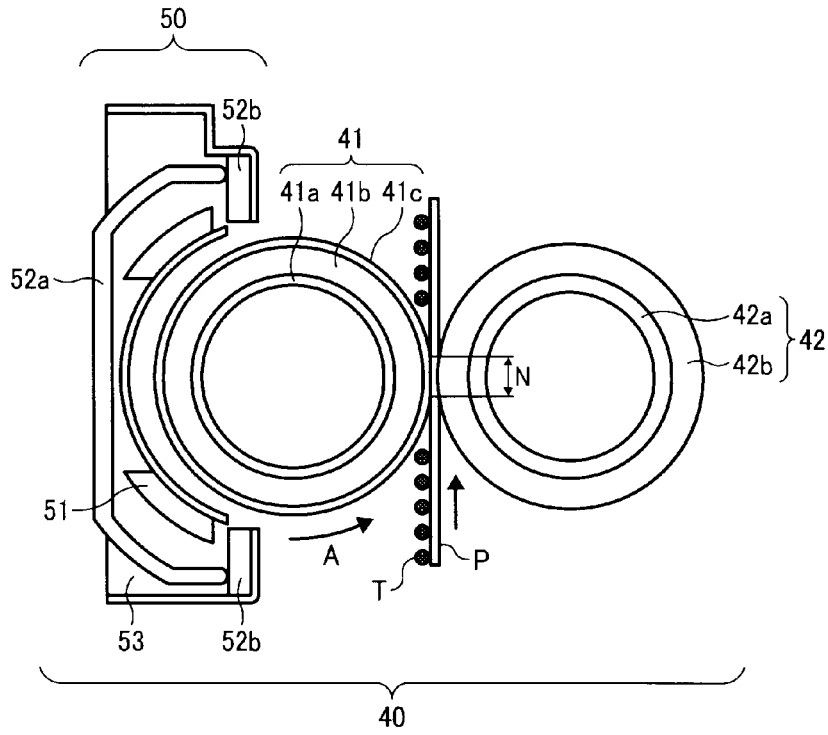
FIG. 9 is a cross-sectional diagram schematically illustrating a fixing device according to a second illustrative embodiment.

Next, with reference to FIG. 9, a description is now provided of the fixing device 40 according to a second illustrative embodiment. FIG. 9 is a cross-sectional diagram schematically illustrating the fixing device 40 of the second illustrative embodiment.

According to the second illustrative embodiment, as illustrated in FIG. 9, the induction heater 50 does not include the center core 52*c*. The surface of the arch core 52*a* facing the fixing roller 41 is located at a place where the center core 52*c* is disposed in the first illustrative embodiment so that the plane of the arch core 52*a* facing the fixing roller 41 can be closer to the fixing roller 41. With this configuration, similar to the first illustrative embodiment, the magnetic circuit is closed, thereby enhancing heat generating efficiency of the fixing roller 41 while reducing the warm-up time and saving energy. As compared with the first illustrative embodiment, because the fixing device of the second illustrative embodiment does not include the center core 52*c*, the cost associated with parts and assembly can be reduced.

Figure 10:
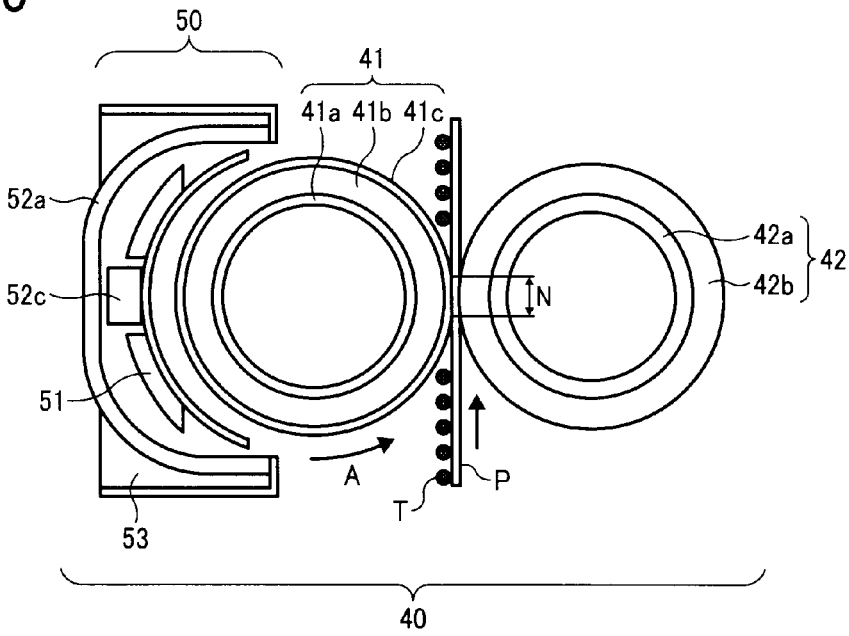
FIG. 10 is a cross-sectional diagram schematically illustrating a fixing device according to a third illustrative embodiment.

Next, with reference to FIG. 10, a description is provided of the fixing device 40 according to a third illustrative embodiment. FIG. 10 is a cross-sectional diagram schematically illustrating the fixing device 40 of the third illustrative embodiment. As illustrated in FIG. 10, the induction heater 50 does not include the side core 52*b* according to the third illustrative embodiment. The center core 52*c* is disposed substantially at the center of the holder 53 and exposed therefrom. The center core 52*c* has a block shape so that the center of the excitation coil 51 is narrowed and hence the excitation coil 51 approaches the center core 52*c*. An overall width of the excitation coil 51 is narrowed. According to the third illustrative embodiment, the width of the excitation coil 51 is narrowed so that the length of the arch core 52*a* in the width direction can be reduced. In this configuration, the heel of the arch core 52*a* is at a place close to the fixing roller 41 where the side core 52*b* is disposed in the foregoing embodiments.

Similar to the first illustrative embodiment, heat generating efficiency of the fixing roller 41 is enhanced while reducing the warm-up time and saving energy. As compared with the first illustrative embodiment, because the fixing device of the third illustrative embodiment does not include the side core 52*b*, the cost associated with parts and assembly can be reduced. Furthermore, because the width of the arch core 52*a* is narrowed, the size of the holder 53 in the width direction can be reduced, hence reducing the size of the image forming apparatus as a whole.

Figure 11:
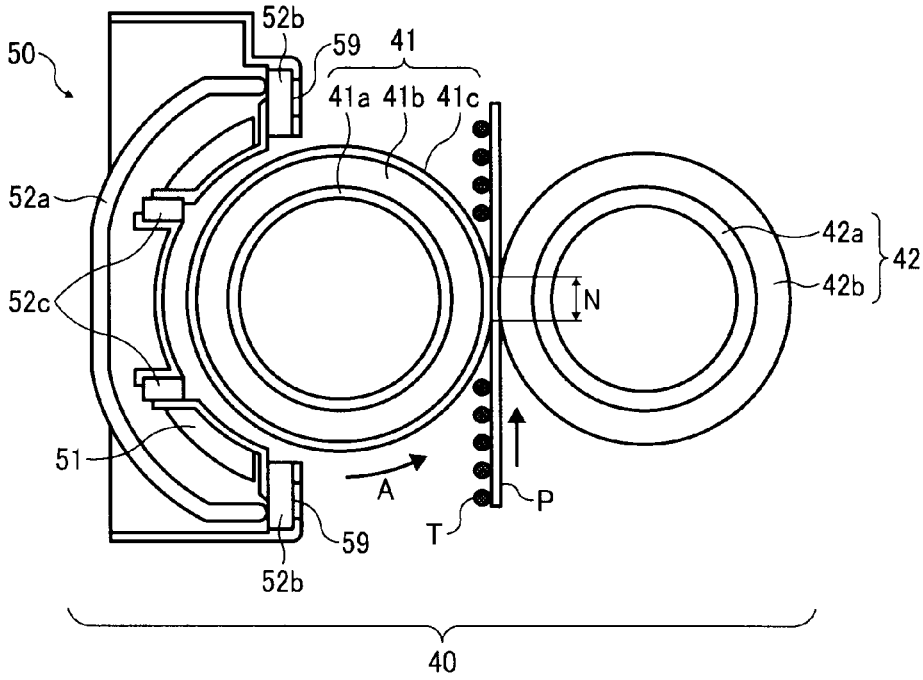
FIG. 11 is schematic diagram illustrating a fixing device according to a fourth illustrative embodiment.
Figure 12:
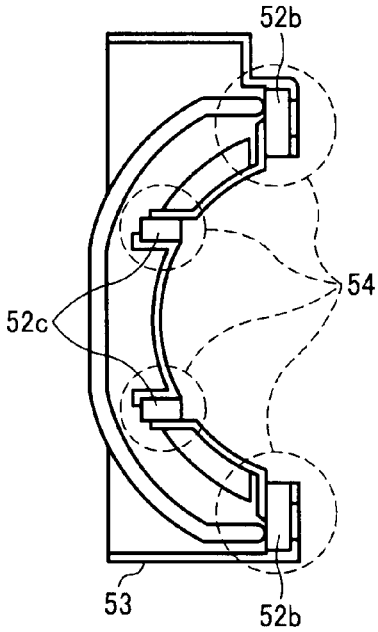
FIG. 12 is a cross-sectional diagram schematically illustrating an induction heater according to the fourth illustrative embodiment.
Figure 13:
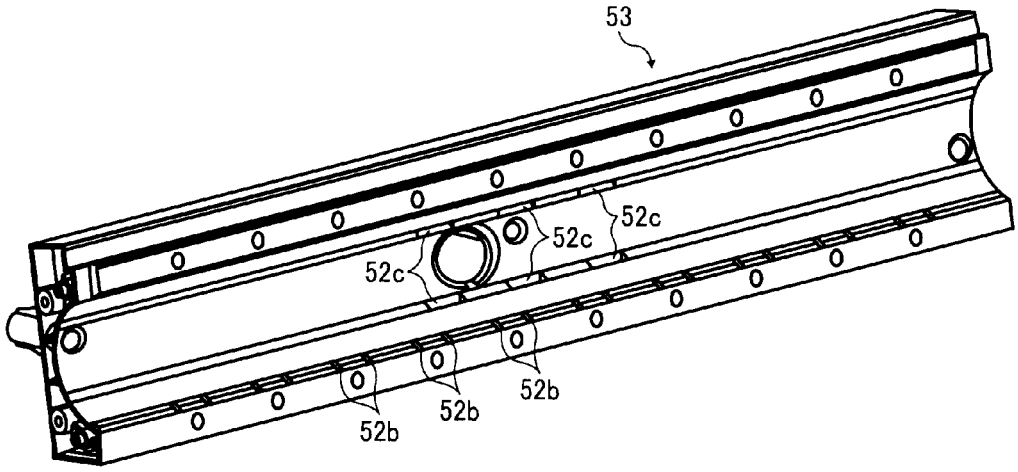
FIG. 13 is a perspective view schematically illustrating the front side of the holder as viewed from the fixing roller side when the side core and the center core are insert molded with the holder as a single integrated unit.
Figure 14A:
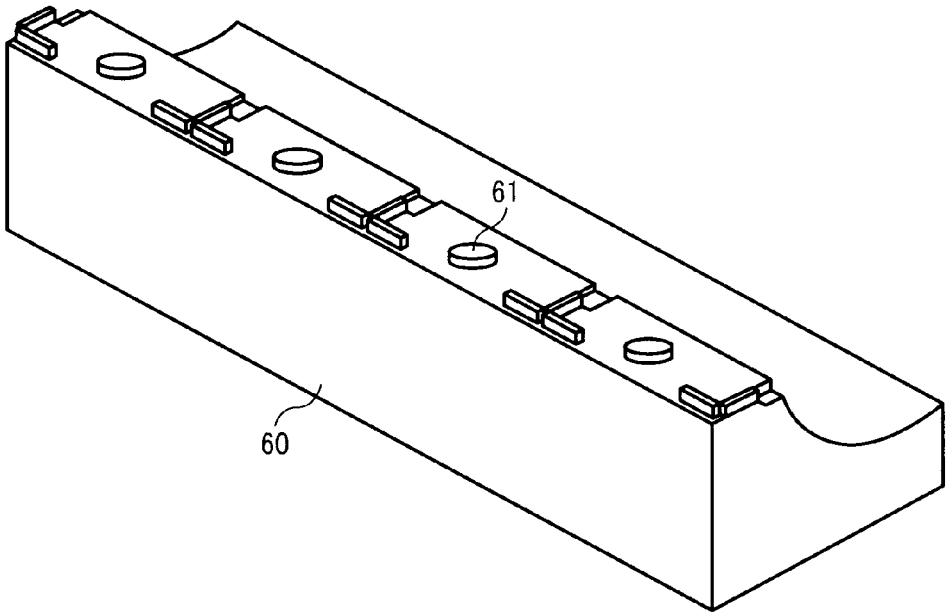
FIG. 14A is a schematic diagram illustrating a fixation block to fix the side core during insert molding.
Figure 14B:
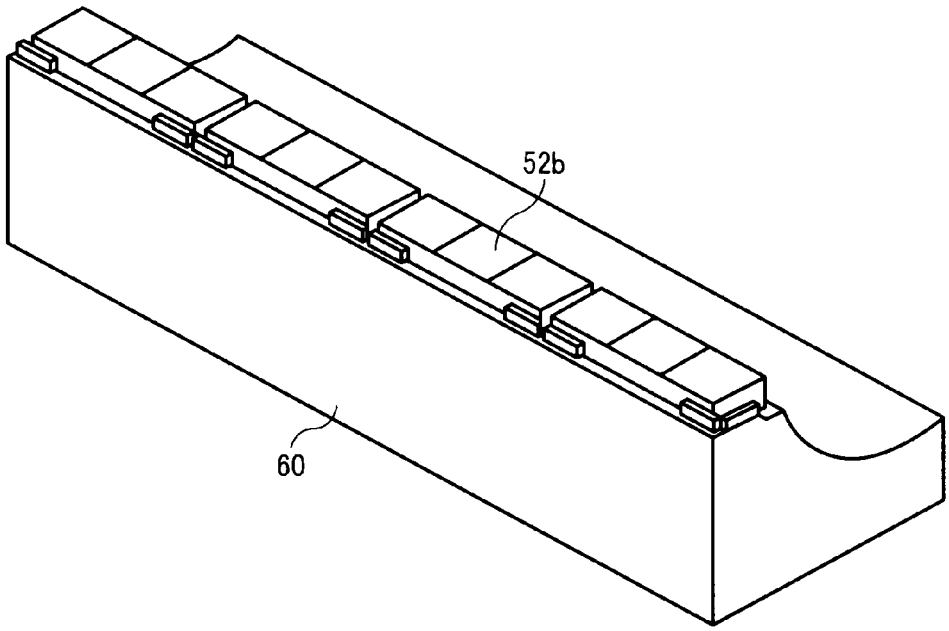
FIG. 14B is a schematic diagram illustrating the fixation block when the side core is fixed to a mold during insert molding.

Next, with reference to FIGS. 11 through 13, a description is now provided of the fixing device 40 according to a fourth illustrative embodiment. FIG. 11 is a cross-sectional view schematically illustrating the fixing device 40 according to the fourth illustrative embodiment. FIG. 12 is a cross-sectional view schematically illustrating the induction heater 50 of the fourth illustrative embodiment. FIG. 13 is a perspective view schematically illustrating the front side of the holder 53 as viewed from the fixing roller side.

According to the fourth illustrative embodiment, the side cores 52*b* and the center cores 52*c*, and the holder 53 constitute a single integrated unit by insert molding. Other cores are adhered to the holder 53.

As illustrated in FIG. 11, similar to the foregoing embodiments, the fixing device 40 includes the induction heater 50 serving as a magnetic flux generator, the fixing roller 41 serving as a heat generating member and also as a fixing member, the pressing roller 42, and so forth. The induction heater 50 includes the excitation coil 51, the arch cores 52*a*, the side cores 52*b*, the center cores 52*c*, the holder 53, and so forth.

As illustrated in FIG. 12, the side cores 52*b* and the center cores 52*c* are molded with the holder 53 by insert molding. In the insert molding process, the side cores 52*b* and the center cores 52*c*, which are magnetic bodies, are placed in a mold, and resin which is material for the holder 53 is injected into the mold, thereby forming a single integrated unit. Accordingly, the side cores 52*b* and the center cores 52*c* are exposed from the holder 53 so that the cores are close to the fixing roller 41 as compared to the related-art fixing device. Similar to the foregoing embodiments, according to the fourth illustrative embodiment, the fixing roller 41 is inductively heated efficiently.

In a case in which the side cores 52*b* and the center cores 52*c* are adhered to the holder 53 as in the first through third illustrative embodiments, a slight gap may be formed undesirably between the wall of the holder 53 and these cores. In order to reduce or eliminate the gap, preferably, arrangement of these cores may be adjusted, or the shape of these cores may be changed. If there is a gap between the wall of the holder 53 and the cores, air circulating at the back of the holder 53 to prevent overheating of the excitation coil 51 and so forth leaks from the gap into the fixing roller side. Consequently, the cooling effect of the air is reduced, and the leaked air cools down the surface of the fixing roller 41 undesirably, complicating efforts to maintain the temperature of the fixing roller 41 high for fusing the toner.

To address this difficulty, as illustrated in FIG. 12, the slight gap between the wall of the holder 53 and the cores is eliminated by insert molding the side core 52*b* and the center core 52*c* with the holder 53 as indicated by broken-line circles 54. The broken-line circles 54 indicate portions subjected to insert molding.

According to the present embodiment, the side cores 52*b* and the center cores 52*c* are molded with the holder 53 by insert molding while the side cores 52*b* and the center cores 52*c* are exposed from the holder 53. Alternatively, these cores may be insert molded with the holder 53 such that these cores are embedded in the wall of the holder 53.

The heat generation efficiency depends substantially on the distance between the fixing roller 41, and the side cores 52*b* and the center cores 52*c*. Even when the holder 53 made of resin intervenes between the cores and the fixing roller 41, the magnetic flux generated by the excitation coil 51 penetrates through the resin holder 53. Thus, the holder 53 does not affect the heat emission efficiency. In other words, the cores can be brought even closer to the fixing roller 41 if the cores are embedded into the wall of the holder 53. In such a case, similar to exposing the cores from the wall of the holder 53, the heat generating efficiency of the fixing roller 41 can be increased.

FIG. 13 is a perspective view schematically illustrating the front side of the holder 53 as viewed from the fixing roller side when the side cores 52*b*, the center cores 52*c*, and the holder 53 are insert molded.

As viewed from the fixing roller side, the side cores 52*b* and the center cores 52*c* are exposed from the holder 53. The surfaces of these cores facing the fixing roller 41 are positioned closer to the fixing roller 41 as compared with the related-art configuration. Furthermore, there is no gap between the wall of the holder 53, and the side cores 52*b* and the center cores 52*c*. The width of the exposed portion of the side cores 52*b* in the longitudinal direction of the holder 53 is narrower than the width of the side cores 52*b* in the longitudinal direction of the side core 52*b* itself. However, the width of the exposed portion is not limited thereto, and may be changed, accordingly. In other words, by increasing the wall portion of the holder 53 subjected to insert molding to reduce the width of the exposed portion of the side cores 52*b*, the strength of the holder 53 is increased. Similarly, the width of the exposed portion of the center core 52*c* in the longitudinal direction of the holder 53 is slightly narrower than the width of the center core 52*c* in the longitudinal direction of the center core 52*c* itself. However, the width of the exposed portion is not limited thereto, and may be changed, accordingly.

A plurality of openings 59, here, 20 pieces of openings 59 are formed in the wall of the holder 53 to correspond to the number of the side cores 52*b*. The openings 59 are used to fix the position of the side cores 52*b* in place relative to the holder 53 during insert molding process. More specifically, a positioning member 61 provided to a mold 60 fixes temporarily the side core 52*b* in place from outside of the holder 53 through the opening 59. As is understood from FIG. 11, the openings 59 do not face the fixing roller 41. Therefore, whether or not the openings 59 are formed in the wall of the holder 53 does not affect heat generating efficiency of the fixing roller 41. The openings 59 contribute to accurate positioning of the side cores 52*b* when manufacturing the holder 53 or during insert molding process. In addition, an opening for the center core 52*c* may be formed in the wall of the holder 53 as necessary.

As described above, because the side core 52*b* and the center core 52*c* are insert molded with the holder 53 as a single integrated unit, the holder 53 and the cores can be assembled simultaneously, thereby reducing the number of manufacturing steps, hence reducing the cost. Furthermore, the undesirable gap between the wall of the holder 53 and the cores is eliminated so that the air for cooling the excitation coil 51 and so forth can be secured at the back of the holder 53. At the front of the holder 53, elimination of the gap can block heat from the fixing roller 41, thereby retaining the temperature of the fixing roller 41. The strength and rigidity of the holder 53 is enhanced as well.

Figure 15A:
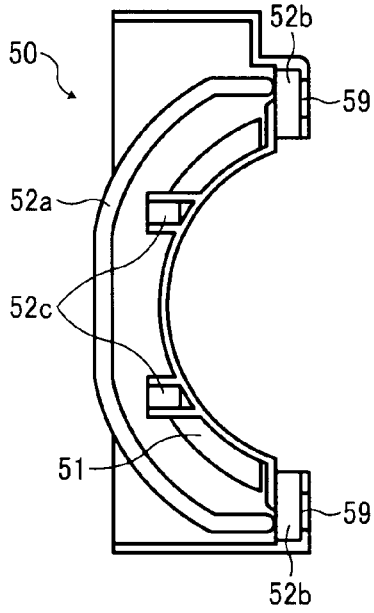
FIG. 15A is a cross-sectional view schematically illustrating the induction heater in which only the side core is insert molded.
Figure 15B:
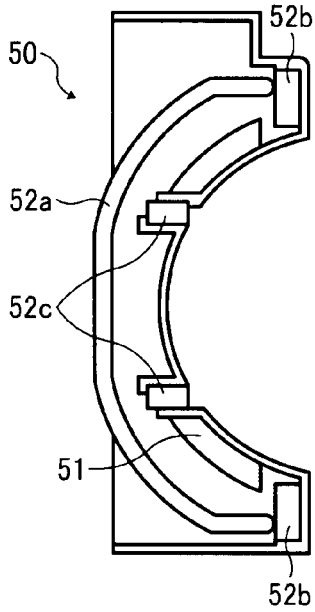
FIG. 15B is a cross-sectional view schematically illustrating the induction heater in which only the center core is insert molded.

As described above, according to the fourth illustrative embodiment, both the side cores 52*b* and the center cores 52*c* are insert molded with the holder 53 to bring the side cores 52*b* and the center cores 52*c* close to the fixing roller 41. Alternatively, as illustrated in FIGS. 15A and 15B, either the side cores 52*b* or the center cores 52*c* may be insert molded with the holder 53. FIG. 15A is a cross-sectional view schematically illustrating the induction heater in which only the side cores 52*b* are insert molded with the holder 53. FIG. 15B is a cross-sectional view schematically illustrating the induction heater in which only the center cores 52*b* is insert molded with the holder 53.

In either case, because the magnetic circuit is closed, the heat generating efficiency of the fixing roller 41 is enhanced while reducing the warm-up time and saving energy as in the foregoing embodiments. An amount of thermal contraction of the side cores 52*b* and the center core 52*c*, both of which are made of magnetic material, differs from that of the resin. The time for cooling the resin portion of the holder 53 after molding process differs from the time required for cooling the portion of the holder 53 where the side cores 52*b* and the center cores 52*c* are insert molded. As a result, deformation occurs easily. By contrast, in a case in which either the side cores 52*b* or the center cores 52*c* are insert molded with the holder 53, deformation can be reduced, hence obtaining reliably a desired shape and increasing process yield.

Figure 16A:
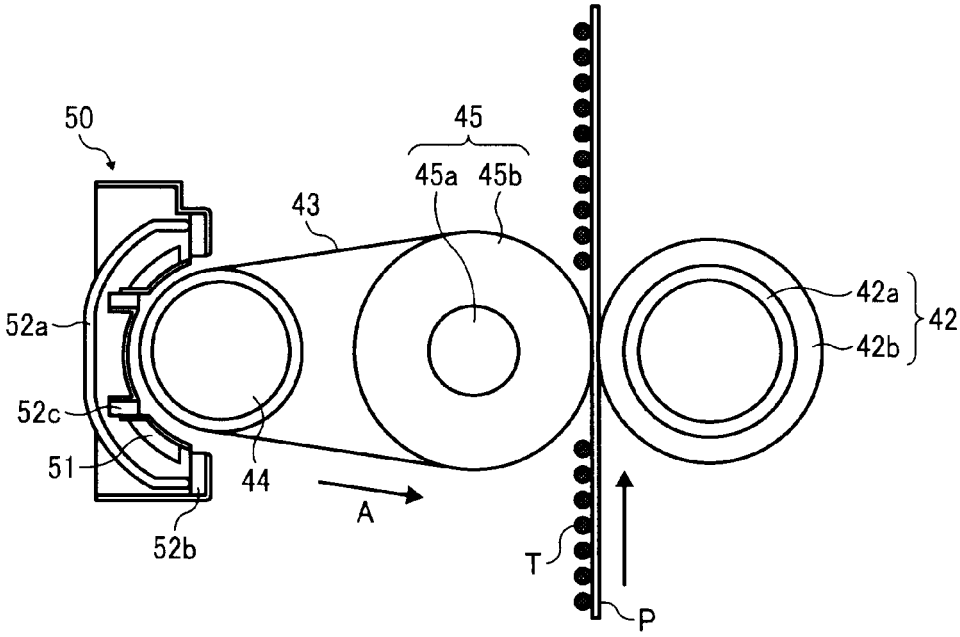
FIG. 16A is a cross-sectional view schematically in a fixing device using a fixing belt, according to a fifth illustrative embodiment.
Figure 16B:
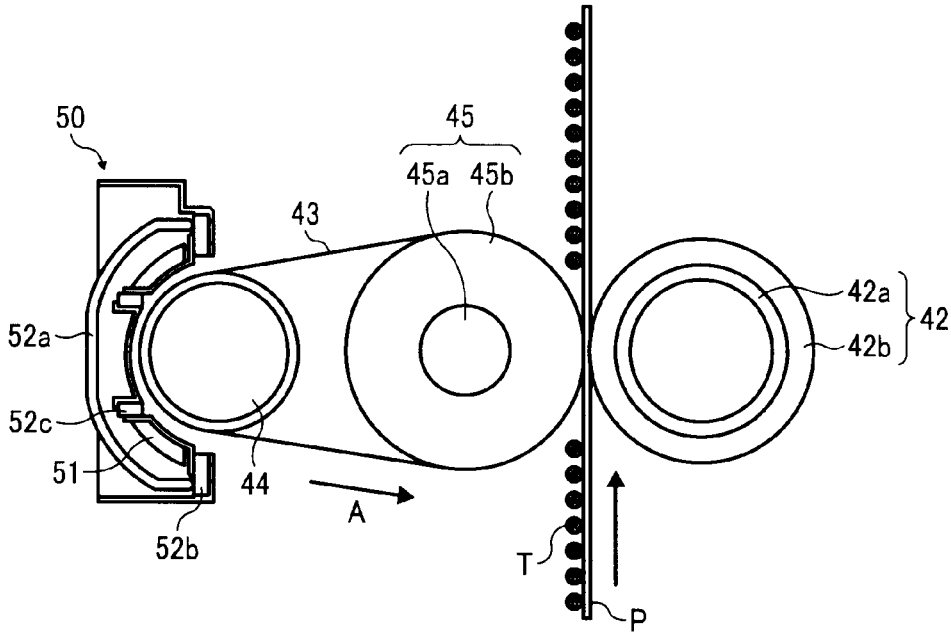
FIG. 16B is a cross-sectional view schematically illustrating another example of the fixing device using the fixing belt, according to the fifth illustrative embodiment.

Next, with reference to FIGS. 16A and 16B, a description is provided of the fixing device 40 according to a fifth illustrative embodiment. FIG. 16A is a cross-sectional view schematically illustrating the induction heater 50 of the first illustrative embodiment implemented in the fixing device using a belt-type fixing member, a fixing belt 43. FIG. 16B is a cross-sectional view schematically illustrating the induction heater 50 of the fourth illustrative embodiment implemented in the fixing device using the fixing belt 43.

According to the fifth illustrative embodiment, the fixing device 40 employs a belt-type fixing member, that is, the fixing belt 43; whereas, in the first and through fourth illustrative embodiments a roller-type fixing member, that is, the fixing roller 41, is employed in the fixing device.

In FIG. 16A, the induction heater 50 in which the side cores 52*b* and the center cores 52*c* are adhered to the holder 53 is implemented in the fixing device using the fixing belt 43. In FIG. 16B, the induction heater 50 in which the side cores 52*b* and the center cores 52*c* are insert molded with the holder 53 is implemented in the fixing device using the fixing belt 43.

According to the fifth illustrative embodiment, the fixing device 40 includes the induction heater 50, the fixing belt 43 serving as a heat generating member and also as a fixing member, a support roller 44 serving as a heat generating member and also as a heating member, a fixing auxiliary roller 45, a pressing roller 42, and so forth.

The support roller 44 includes a metal core made of SUS having a thickness in a range of from approximately 0.2 mm to 1 mm. The surface of the metal core is formed of copper (Cu) and has a thickness in a range of from 3 μm to 15 μm to enhance heat generating efficiency. The surface of the metal core formed of copper (Cu) may be plated with nickel (Ni) to prevent corrosion. Alternatively, a magnetic shunt alloy having the Curie point in a range of from approximately 160° C. to 220° C. may be used. An aluminum member may be disposed inside the magnetic shunt alloy, thereby stopping the temperature from rising near the Curie point.

The fixing auxiliary roller 45 consists of a metal core 45*a* and an elastic member 45*b* provided on the metal core 45*a*. The metal core 45*a* is made of metal, for example, stainless steel, carbon steel, and the like. The elastic member 45*b* is made of heat-resistant solid or foam silicone rubber. The pressing roller 42 presses against the fixing auxiliary roller 45, thereby forming the fixing nip N having a predetermined width between the pressing roller 42 and the fixing auxiliary roller 45. The outer diameter of the fixing auxiliary roller 45 is in a range of from approximately 30 mm to 40 mm. The thickness of the elastic member 45*b* is in a range of from approximately 3 mm to 10 mm. The stiffness thereof is in a range of from approximately 10° to 50° in accordance with JIS-A.

Figure 17:
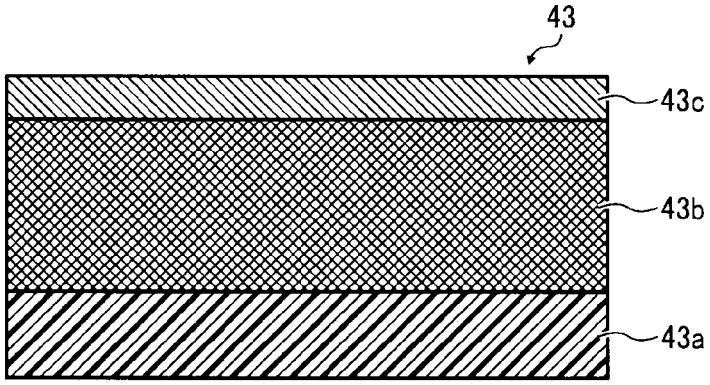
FIG. 17 is a cross-sectional view schematically illustrating the fixing belt.

Next, a detailed description is provided of the fixing belt 43 with reference to FIG. 17. FIG. 17 is a cross-sectional view schematically illustrating the fixing belt 43.

As illustrated in FIG. 17, the fixing belt 43 has a multi-layer structure including an elastic layer 43*b* disposed on a base member 43*a* and a release layer 43*c* disposed on the elastic layer 43*b*.

It is desirable that the base member 43*a* have sufficient mechanical endurance and flexibility when stretched, and heat resistant properties at the fixing temperature. In view of the above, the base member 43*a* is made of heat resistant, insulating resin material to inductively heat the support roller 44. The resin material includes, but is not limited to, polyimide, polyimideamide, polyether ether ketone (PEEK), polyethersulfone (PES), polyphenylene sulfide (PPS), and fluorocarbon resin. In light of heat capacity and endurance, it is desirable that the thickness of the base member 43*a* be in a range of from approximately 30 μm to 200 μm.

In order to obtain an image with even glossiness, the elastic layer 43*b* is disposed on the belt surface so that the belt surface is substantially soft. The elastic layer 43*b* is made of rubber. The hardness of the rubber is in a range of from approximately 5° to 50° according to JIS-A, and the thickness thereof is in a range of from approximately 50 μm to 500 μm. The elastic layer 43*b* needs to be tolerant to heat at the fixing temperature. Hence, the rubber used in the elastic layer 43*b* includes, but is not limited to silicone rubber and fluorosilicone rubber.

The release layer 43*c* may include, but is not limited to, fluorocarbon resin such as, polytetrafluoroethylene (PTFE), perfluoroalkoxy polymer resin (PFA), and fluorinated ethylene propylene (FEP), or a mixture of these resins, or fluorocarbon resin dispersed in a heat-resistant resin.

Covering the elastic layer 43*b* with the release layer 43*c* can prevent toner and paper dust from sticking to the fixing belt 43. Therefore, no silicone oil needs to be applied to the surface of the fixing belt 43. Generally, the resin having releasing properties is not as elastic as rubber. Thus, if the release layer 43*c* is too thick, the surface of the fixing belt 43 becomes stiff, causing gloss unevenness. In order to obtain both releasability and softness, the thickness of the release layer 43*c* is in a range of from approximately 5 μm to 50 μm, preferably, in a range of from 10 μm to 30 μm.

A primer layer may be provided between the layers as needed. Still alternatively, a layer may be provided to the inner surface of the base member 43*a* to enhance the endurance thereof when moving slidably. Preferably, the base member 43*a* may include a heat generating layer. For example, as the heat generating layer, a layer made of copper (Cu) having a layer thickness in a range of from approximately 3 μm to 15 μm may be formed on the base layer of polyimide or the like.

The pressing roller 42 employed in the fixing device 40 has the same configuration as the first illustrative embodiment. That is, the pressing roller 42 includes the cylinder member 42*a* made of metal such as aluminum and copper and the elastic layer 42*b* provided on the cylinder member 42*a*. The elastic layer 42*b* is made of rubber such as fluorocarbon rubber and silicone rubber. The elastic layer 42*b* of the pressing roller 42 has a thickness in a range of from approximately 0.5 mm to 2 mm and a hardness thereof in a range of from 20° to 50° on the Asker C scale.

The fixing belt 43 rotates in the counterclockwise direction indicated by an arrow A shown in FIGS. 16A and 16B. The heat generating layer of the fixing belt 43 is heated directly and inductively by the magnetic flux from the induction heater 50.

As illustrated in FIGS. 16A and 16B, the induction heater 50 has the same configuration as the first illustrative embodiment. That is, the induction heater 50 includes the excitation coil 51, the arch cores 52*a*, the side cores 52*b*, the center cores 52*c*, and the holder 53, and so forth.

Similar to the first illustrative embodiment, a plurality of arch cores 52*a* is disposed facing the outer circumferential surface of the support roller 44 in a circumference direction via the excitation coil 51 and contacts the side cores 52*b*. A plurality of side cores 52*b* and center cores 52*c* are disposed in the longitudinal direction of the holder 53. The side cores 52*b* and the center cores 52*c* may be connected to one another, or may be spaced apart a certain distance. The side cores 52*b* and the center cores 52*c* are arranged facing the fixing auxiliary roller 45. The side cores 52*b* and the center cores 52*c* are exposed from the holder 53. The side cores 52*b* and the center cores 52*c* are fixed to the holder 53 using adhesive such as shown in FIG. 16A, or by insert molding such as shown in FIG. 16B. In a case of insert molding, the side cores 52*b* and the center cores 52*c* may be embedded in the holder 53, instead of exposing the side cores 52*b* and the center cores 52*c* from the holder 53.

Next, a description is provided of operation of the fixing device 40 according to the fifth illustrative embodiment.

As the fixing auxiliary roller 45 rotates, the fixing belt 43 is rotated in the direction of arrow A in FIGS. 16A and 16B while the support roller 44 is rotated in the counterclockwise direction. The pressing roller 42 rotates in the clockwise direction. The fixing belt 43 is heated inductively when the fixing belt 43 arrives at the position opposite the induction heater 50.

More specifically, a high-frequency alternating current in a range of from 20 kHz to 1 MHz (preferably, in a range of from 20 kHz to 100 kHz) is supplied from a power source to the excitation coil 51. Accordingly, a line of magnetic force switches alternately between the excitation coil 51, and the support roller 44 and the fixing belt 43. As the alternating magnetic field is formed, the eddy current is generated on the surface of the support roller 44 and the heat generating layer of the fixing belt 43. Due to an electrical resistance of the support roller 44 and the heat generating layer of the fixing belt 43, the Joule heat is generated, thereby heating the support roller 44 and the heat generating layer of the fixing belt 43. With this configuration, the fixing belt 43 serves as a heat generating member directly heated by the heat generating layer of the fixing belt 43 itself and the support roller 44 which has been heated. The fixing belt 43 also serves as an indirect heat generating member which is heated indirectly by the induction heater 50 via the support roller 44.

Subsequently, the surface of the fixing belt 43 heated by the induction heater 50 comes to face the pressing roller 42 which presses against the fixing auxiliary roller 45 via the fixing belt 43. The recording medium P bearing the toner image T is conveyed to the fixing nip N between the pressing roller 42 and the fixing roller 41 by a guide member, and the toner image T is heated and fused in the fixing nip N, thereby fixing the toner image T onto the recording medium P. The surface of the fixing belt 43 that has passed through the fixing nip comes to the position opposite the induction heater 50 again. This completes a sequence of the fixing operation.

As described above, according to the fifth illustrative embodiment, in addition to the arch cores 52*a* facing the outer circumferential surface of the fixing belt 43 and the support roller 44 via the excitation coil 51, the plurality of side cores 52*b* and center cores 52*c* are arranged in the longitudinal direction of the holder 53 opposite the outer circumferential surface of the fixing belt 43 and the support roller 44. The plurality of side cores 52*b* and center cores 52 are closer to the fixing belt 43 and the support roller 44 than from the arch cores 52*a*. Furthermore, the side cores 52*b* and the center cores 52*c* are exposed from or embedded to the holder 53 so that the side cores 52*b* and the center cores 52*c* can be disposed closer to the fixing belt 43 and the support roller 44 as compared with the related-art fixing device. With this configuration, the heat emission efficiency of the fixing belt 43 and the support roller 44 is enhanced without increasing the number of parts in the induction heater 50. Further, the warm-up time and energy consumption are reduced as is usually desired.

According to the fifth illustrative embodiment, both the fixing belt 43 and the support roller 44 are inductively heated by the induction heater. Alternatively, one of the fixing belt 43 and the support roller 44 is heated by the induction heater 50. For example, if the fixing belt 43 does not include a heat generating layer, the support roller 44 can serve as the heat generating member which is heated inductively by the induction heater 50 to heat the fixing belt 43. With this configuration, the same effect as that of the foregoing embodiments can be achieved.

According to the fifth illustrative embodiment, the induction heater 50 is disposed opposite the outer circumferential surface of the support roller 44 via the fixing belt 43. Alternatively, the induction heater 50 may be disposed directly opposite the outer circumferential surface of the support roller 44. In other words, the induction heater 50 may be disposed directly opposite the support roller 44 without the fixing belt 43 between the induction heater 50 and the support roller 44. In this configuration, the same effect as that of the third illustrative embodiment can be achieved.

According to the fifth illustrative embodiment, the side cores 52*b* and the center cores 52*c* are exposed from or embedded in the holder 53 so that the side cores 52*b* and the center cores 52*c* are close to the fixing belt 43. Alternatively, either the side cores 52*b* or the center cores 52*c* may be exposed from or embedded in the holder 53. In this case, because the magnetic circuit is closed, the heat generating efficiency of the fixing belt 43 is enhanced as in the foregoing embodiments while reducing the warm-up time and hence saving energy.

It is to be noted that the number, the position, and the shape of the side cores and center cores are not limited to the foregoing embodiments.

According to the illustrative embodiment, the teachings of this disclosure are employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present disclosure, and all such modifications as would be obvious to one skilled in the art are intended to be included within the scope of the following claims.

What is claimed is:

1. An induction heating-type fixing device, comprising:

a fixing member including a heat generating layer to heat and fuse a toner image on a recording medium;

an excitation coil wound a predetermined number of times and facing an outer surface of the fixing member, to generate a magnetic flux relative to the fixing member;

a magnetic core to form a continuous magnetic path to direct the magnetic flux generated by the excitation coil to the fixing member, the magnetic core including a plurality of side cores disposed at sides of the excitation coil and facing the fixing member;

a holder to hold the excitation coil and the magnetic core, the plurality of side cores is exposed from the holder, the holder includes a plurality of notches and a plurality of reinforcing members to reinforce the holder, and the plurality of reinforcing members is disposed between the plurality of side cores; and a pressing member disposed opposite the fixing member to press against the fixing member and form a fixing nip between the fixing member and the pressing member through which the recording medium is conveyed, the magnetic core exposed from the holder at a fixing member side.

2. The fixing device, according to claim 1, wherein the magnetic core comprises:

a plurality of arch cores disposed facing the outer surface of the fixing member with the exciting coil disposed therebetween, the plurality of side cores contacting the arch cores; and a plurality of center cores disposed in a center of windings of the excitation coil and facing the fixing member.

3. The fixing device according to claim 2, wherein at least one of the plurality of the side cores and the plurality of center cores are adhered to the holder using an adhesive agent.

4. The fixing device, according to claim 2, wherein at least one of the plurality of side cores and the plurality of center cores are inserted through the notches, wherein the reinforcing members are each disposed between each of the plurality of side cores and the plurality of center cores in a longitudinal direction of the holder.

5. The fixing device according to claim 4, wherein the plurality of reinforcing members are ribs.

6. The fixing device, according to claim 1, wherein the magnetic core comprises:

a plurality of arch cores disposed facing the outer surface of the fixing member with the exciting coil disposed therebetween; and a plurality of side cores disposed at sides of the excitation coil and facing the fixing member, the plurality of side cores contacting the arch cores, wherein the plurality of side cores are exposed from the holder at the fixing member side.

7. The fixing device, according to claim 1, wherein the magnetic core comprises:

a plurality of arch cores disposed facing the outer surface of the fixing member via the exciting coil; and a plurality of center cores disposed in a center of the wound excitation coil and facing the fixing member, wherein the center cores are exposed from the holder at the fixing member side.

8. The fixing device, according to claim 1, wherein the fixing member is a fixing roller and the pressing member is a pressing roller that presses against a recording medium conveyed to the fixing nip.

9. The fixing device, according to claim 1, wherein the pressing member is a pressing roller and the fixing member comprises:

a support roller;

an auxiliary roller disposed opposite the support roller; and a fixing belt formed into a loop and wound around the support roller and the auxiliary roller, the auxiliary roller contacting the pressing roller with the fixing belt disposed therebetween.

10. An induction-heating type fixing device, comprising:

a fixing member including a heat generating layer to heat and fuse a toner image on a recording medium;

an excitation coil wound a predetermined number of times and facing an outer surface of the fixing member, to generate a magnetic flux relative to the fixing member;

a magnetic core to form continuous magnetic path to direct the magnetic flux generated by the excitation coil to the fixing member, the magnetic core including a plurality of side cores disposed at sides of the excitation coil and facing the fixing member;

a holder to hold the excitation coil and the magnetic core, the holder includes a plurality of notches and a plurality of reinforcing members to reinforce the holder, and the plurality of reinforcing members is disposed between the plurality of side cores; and a pressing member disposed opposite the fixing member, to press against the fixing member and form a fixing nip between the fixing member and the pressing member through which the recording medium is conveyed;

wherein the magnetic core is embedded in a wall of the holder.

11. The fixing device according to claim 10, wherein the magnetic core comprises:

a plurality of arch cores disposed facing the outer surface of the fixing member via the exciting coil the plurality of side cores contacting the arch cores; and a plurality of center cores disposed in a center of windings of the excitation coil and facing the fixing member.

12. The fixing device according to claim 11, wherein at least one of the plurality of side cores and the plurality of center cores are insert molded with the holder.

13. The fixing device according to claim 12, wherein the holder includes a plurality of openings and a positioning member that temporarily fixes the position of at least one of the plurality of side cores and the plurality of center cores in place relative to the holder from outside the holder through the openings.

14. An image forming apparatus, comprising:

an image bearing member to bear an electrostatic latent image on a surface thereof;

a developing device to develop the electrostatic latent image formed on the image bearing member using toner to form a toner image;

a transfer device to transfer the toner image onto the recording medium; and the induction heating-type fixing device of claim 1.

* * * * *